US007029008B2

(12) United States Patent
Nishida et al.

(10) Patent No.: US 7,029,008 B2
(45) Date of Patent: Apr. 18, 2006

(54) ACCUMULATING DEVICE AND CIRCULATING TYPE BANK NOTE DEPOSITING AND DISPENSING MACHINE

(75) Inventors: Mitsuo Nishida, Aioi (JP); Toshihiko Kobayashi, Hyogo (JP); Tsuguo Mizoro, Hyogo (JP); Toyoshige Kuroiwa, Himeji (JP); Kosaku Fukuda, Ako (JP)

(73) Assignee: Glory Ltd., Hyogo (JP)

( * ) Notice: Subject to any disclaimer, the term of this patent is extended or adjusted under 35 U.S.C. 154(b) by 190 days.

(21) Appl. No.: 10/694,399

(22) Filed: Oct. 28, 2003

(65) Prior Publication Data

US 2004/0145111 A1 Jul. 29, 2004

(30) Foreign Application Priority Data

Oct. 30, 2002 (JP) ..... 2002-316642

(51) Int. Cl.
*B65H 31/20* (2006.01)

(52) U.S. Cl. ..... 271/223; 271/224; 271/215; 271/217

(58) Field of Classification Search ..... 271/220, 271/221, 222, 223, 224, 207, 213, 214, 215, 271/217, 176
See application file for complete search history.

(56) References Cited

U.S. PATENT DOCUMENTS 3,342,481 A * 9/1967 Kaplan ..... 271/178
3,905,487 A * 9/1975 Hoke et al. ..... 414/789.1
3,907,128 A * 9/1975 Cathers ..... 414/788.9
3,992,001 A * 11/1976 Martin ..... 271/184
4,260,148 A * 4/1981 Diesch et al. ..... 271/219
4,273,325 A * 6/1981 Rodewald ..... 271/220
4,647,265 A * 3/1987 Uno ..... 414/790.2
4,750,853 A * 6/1988 Van Soest et al. ..... 414/789.9

(Continued)

FOREIGN PATENT DOCUMENTS

JP 61-141091 6/1986

(Continued)

*Primary Examiner*—Donald P. Walsh
*Assistant Examiner*—Matthew J. Kohner
(74) *Attorney, Agent, or Firm*—Morrison & Foerster LLP

(57) ABSTRACT

To provide an accumulating device 71 that is capable of securely accumulating sheets or the like P having dimensional differences on the basis of the rear ends in the taking-in direction thereof.

The stopper 111*a* advances from upward to the advanced position between the tip end regulating wall 79 and the rear end regulating wall 80 and stops the tip ends in the taking-in direction of sheets or the like P to be taken in, whose length in the taking-in direction of sheets or the like P is shorter than the maximum length. The stopper 111*a* is supported movably in the vertical direction with respect to the advancing and retreating mechanism by which the stopper 111*a* is caused to advance and retreat between the advanced position and the retreated position, and presses sheets or the like P in the downward direction. The stopper 111*a* that has advanced to the advanced position is changed over to a state where the stopper is brought into contact with the upper surface of the accumulated sheets or the like P in response to the length in the taking-in direction of the accumulated sheets or the like P and a state where it advances to the tip end side in the taking-in direction of the accumulated sheets P or the like. The stopper 111*a* stops the tip ends in the taking-in direction of sheets or the like P having dimensional differences and accumulates sheets or the like P having dimensional differences on the basis of the rear ends in the taking-in direction thereof.

9 Claims, 11 Drawing Sheets

U.S. PATENT DOCUMENTS 4,773,638 A * 9/1988 Koutoudis et al. ..... 271/223
4,828,246 A * 5/1989 Wegel et al. ..... 271/182
4,838,539 A * 6/1989 Zimmermann ..... 271/305
4,905,979 A * 3/1990 Limbach et al. ..... 271/176
5,372,360 A * 12/1994 Ricciardi ..... 271/177
5,374,051 A * 12/1994 Ulrich et al. ..... 271/222
5,562,281 A * 10/1996 Honda et al. ..... 271/308
5,613,673 A * 3/1997 Roberts et al. ..... 271/182
5,749,571 A * 5/1998 Heiler ..... 271/213
5,879,000 A * 3/1999 Kakuta ..... 271/3.02
5,906,367 A * 5/1999 Takagaki ..... 271/218
5,931,456 A * 8/1999 Laidlaw ..... 271/171
6,354,588 B1 * 3/2002 Kuwahara et al. ..... 271/224
6,572,102 B1 * 6/2003 Vedoy ..... 271/224
6,588,744 B1 * 7/2003 Ries et al. ..... 271/220
6,877,739 B1 * 4/2005 Leitz et al. ..... 271/178
2004/0084836 A1 * 5/2004 Lindenmayer et al. ..... 271/176

FOREIGN PATENT DOCUMENTS

JP 02100960 A * 4/1990
JP 02310250 A * 12/1990
JP 04-350060 12/1992
JP 05310359 A * 11/1993

* cited by examiner

ACCUMULATING DEVICE AND CIRCULATING TYPE BANK NOTE DEPOSITING AND DISPENSING MACHINE

BACKGROUND OF THE INVENTION

1. Field of the Invention

The present invention relates to an accumulating device for accumulating bank notes, which have differences in size, in a mixed state, and a circulating type bank note depositing and dispensing machine using the accumulating device.

2. Related Background Art

For example, an accumulating device for accumulating sheets or the like (hereinafter, bank notes, bills and cards, etc., are called "sheets or the like") such as banknotes, bills, and cards, etc., which have differences in size, in a mixed state is used as a bank note depositing machine, a bank note dispensing machine, a circulating type bank note depositing and dispensing machine, bank note exchange machine, a bill processing machine, and a card processing machine, etc.

In a prior art accumulating device (for example, refer to Patent Document No. 1), the tip ends in the taking-in direction of sheets or the like which are taken in from a conveying passage sheet by sheet are stopped by a movable tip end stopping member, and at the same time, the rear tip ends in the taking-in in direction of the sheets or the like are regulated by the rear end regulating wall at a fixed position. And, the sheets or the like are accumulated on an accumulating stacker in the vertical direction. The accumulating stacker descends in response to an increase in the accumulation quantity of the sheets or the like. With respect to the movable tip end stopping member, the upper area of the accumulating stacker is made movable in the direction corresponding to the taking-in direction of sheets or the like, the interval between the movable tip end stopping member and the rear end regulating wall is adjusted, corresponding to the length in the taking-in direction of the sheets or the like, and sheets or the like having different lengths in the taking-in direction are accumulated on the basis of the rear ends in the taking-in direction, wherein the sheets or the like are firm corrugated cardboard. Also, when a prescribed number of sheets or the like are accumulated on the accumulating stacker, the group of sheets or the like is collectively transferred to subsequent processes.

In addition, there is a circulating type bank note depositing and dispensing machine which is capable of depositing and dispensing bank notes as sheets or the like and in which the deposited bank notes can be circulatively used as dispensing bank notes (for example, refer to Patent Document No. 2).

Patent Document No.1: Japanese Unexamined Patent Application Publication No. Hei-4-350060 (Pages 5 and 6, and FIG. 7)

Patent Document No.2: Japanese Unexamined Patent Application Publication No. Sho-61-141091 (Page 1, and FIG. 2)

SUMMARY OF THE INVENTION

However, in the prior art accumulating device, firm corrugated cardboard is the object sheet to be handled by the device. Whereas flimsy sheets or the like, for example, bank notes and bills, thin and easily deformable cards are handled, the tip ends in the taking-direction of the sheets or the like hang down during taking-in, and penetrate between the movable tip end stopping member and the upper surface of accumulated sheets or the like and stop there. Finally, the rear ends in the taking-in direction of the sheets or the like are accumulated at a position apart from the rear end regulating wall, wherein a problem is caused in accumulation slip.

Also, in the prior art accumulating device, where a prescribed number of sheets or the like are accumulated on the accumulating stacker, the sheets or the like are collectively transferred to subsequent processes, wherein sheet-by-sheet taking-in and sheet-by-sheet taking-out are not enabled. However, in a case of bank notes, an accumulating device capable of taking in and taking out bank notes sheet by sheet and also taking out bank notes through a taking-in port through which the bank notes are taken in is desired, and in particular, an accumulating device capable of taking in and taking out bank notes having dimensional differences is desired. However, such a prior art accumulating device is not provided with such features, wherein there is a problem in that the accumulating device does not correspond to such a need.

The present invention was developed to solve such a problem, and it is therefore a first object of the invention to provide an accumulating device capable of securely accumulating sheets or the like having dimensional differences on the basis of the rear ends in the taking-in direction thereof, and further a second object of the invention to provide an accumulating device capable of securely accumulating sheets or the like having dimensional differences on the basis of the rear ends in the taking-in direction thereof and simultaneously securely taking out the sheets or the like sheet by sheet, and to provide a circulating type bank note depositing and dispensing machine.

An accumulating device according to a first aspect of the invention is an accumulating device for accumulating sheets or the like, which have differences in size, in a mixed state, comprising: an information detecting portion, which is provided in a conveying passage for conveying sheets or the like, for detecting information pertaining to the length in the taking-in direction of sheets or the like; a sheet or the like accumulating portion including an accumulating space portion for accumulating the sheets or the like, means for taking in the sheets or the like, which are taken from the conveying passage, in the accumulating space portion sheet by sheet, an accumulating stacker for accumulating sheets or the like taken in the accumulating space portion in the vertical direction, an accumulating stacker drive portion for driving to lower the accumulating stacker when taking in the sheets or the like, a tip end regulating wall for regulating the tip end in the taking-in direction of the sheets or the like having the maximum length in the taking-in direction of sheets or the like which are taken in, a rear end regulating wall for regulating the rear end in the taking-in direction of the sheets or the like to be taken in, at least one stopper that can advance and retreat between an advancement position at which the tip end in the taking-in direction of sheets or the like, advancing from upward between the tip end regulating wall and the rear end regulating wall and being taken in, whose length in the taking-in direction of the sheets or the like is shorter than the maximum length and a retreating position where the sheets or the like retreat from the advancing position, a stopper supporting means for supporting the stopper so as to be movable in the vertical direction and simultaneously pressing the same in the downward direction, and changing the stopper to a state where the stopper advancing to its advanced position is brought into contact with the upper surface of accumulated sheets or the like in response to the length in the taking-in direction of the accumulated sheets or the like and the tip ends in the taking-in direction of the sheets or the like taken in while the upper surface thereof are being pressed are stopped, and a state where the stopper advances to the tip end side in the taking-in direction of the accumulated sheets or the like and the tip ends in the taking-in direction of sheets or the like taken in while the tip ends in the taking-in direction thereof are being stopped, and a stopper driving portion for driving the stopper to advance and retreat between the advanced position and retreated position of the stopper; and a controlling portion for controlling the accumulating stacker driving portion so that, when taking in the sheets or the like, the upper surface position of the accumulated sheets or the like is located at a constant height, and simultaneously controlling the stopper driving portion on the basis of detection of sheets or the like by the information detecting portion for detecting information pertaining to the length in the taking-in direction of sheets or the like.

And, with such a construction, since at least a stopper that advances from upward to the advanced position between the tip end regulating wall and the rear end regulating wall and stops the tip end in the taking-in direction of sheets or the like, the lengths of which are shorter than the maximum length in the taking-in direction of sheets or the like taken in, is supported to be vertically movable, and is pressed in the downward direction, the stopper that advances to the advanced position is changed over to a state where the stopper advancing to its advanced position is brought into contact with the upper surface of accumulated sheets or the like in response to the length in the taking-in direction of the accumulated sheets or the like and the tip ends in the taking-in direction of the bank notes taken in while the upper surface thereof are being pressed are stopped, and a state where the stopper advances to the tip end side in the taking-in direction of the accumulated sheets or the like and the tip ends in the taking-in direction of sheets or the like taken in while the tip ends in the taking-in direction thereof are being stopped. Therefore, the tip ends in the taking-in direction of sheets or the like having dimensional differences can be securely stopped by the stopper, and it is possible to securely accumulate the sheets or the like having dimensional differences on the basis of the rear ends in the taking-in direction thereof.

An accumulating device according to a second aspect of the invention is featured in that the sheets or the like are bank notes in addition to the accumulator device according to the first aspect.

With such a construction, it is possible to securely accumulate bank notes even if the bank notes are flimsy.

The accumulating device according to a third aspect of the invention is featured, in addition to the accumulating device according to the first aspect or the second aspect, in that it comprises; at least one guiding member for swingably guiding the tip ends in the taking-in direction of sheets or the like taken in by the taking-in means onto the upper surface of the accumulated sheets or the like, wherein the tip ends in the taking-in direction of the sheets or the like guided by said at least one guiding member and moved on the upper surface of the accumulated sheets or the like are stopped by any one of the stopper and tip end regulating walls.

And, with the construction, the tip ends in the taking-in direction of the sheets or the like are guided onto the upper surface of already accumulated sheets or the like by said at least one guiding member, and it is possible to prevent sheets or the like, which are taken in, from being deformed on the upper surface of the already accumulated sheets or the like, in order to reinforce the flimsiness of subsequent sheets or the like passing on the upper surface of the already accumulated sheets or the like, wherein the accumulation of sheets or the like can be securely carried out by securely stopping the tip ends in the taking-in direction of the sheets or the like by either one of the stopper or the tip end regulating walls.

An accumulating device for accumulating bank notes, which have differences in size, in a mixed state, according to a fourth aspect of the invention, comprises; a bank note identification portion, which is provided in a conveying passage for conveying bank notes, for identifying the denominations of bank notes; a bank note accumulating portion including an accumulation space in which the bank notes are accumulated, a taking-in and taking-out means for taking in bank notes, which are taken from the conveying passage, in the accumulation space portion, sheet by sheet and taking out the bank notes sheet by sheet as necessary, an accumulating stacker for accumulating bank notes taken in the accumulation space portion in the vertical direction, an accumulating stacker driving portion for driving to elevate and lower the accumulating stacker, a tip end regulating wall for regulating the tip end in the taking-in direction of the bank notes having the maximum length in the taking-in direction of bank notes which are taken in, a rear end regulating wall for regulating the rear end in the taking-in direction of the bank notes to be taken in, at least one stopper that can advance and retreat between an advancement position at which the tip end in the taking-in direction of bank notes, advancing from upward between the tip end regulating wall and the rear end regulating wall and being taken in, whose length in the taking-in direction of the bank notes is shorter than the maximum length and a retreating position where the bank notes retreat from the advancing position, a stopper supporting means for supporting the stopper so as to be movable in the vertical direction and simultaneously pressing the same in the downward direction, and changing the stopper to a state where the stopper advancing to its advanced position is brought into contact with the upper surface of accumulated bank notes in response to the length in the taking-in direction of the accumulated bank notes and the tip ends in the taking-in direction of the bank notes taken in while the upper surface thereof are being pressed are stopped, and a state where the stopper advances to the tip end side in the taking-in direction of the accumulated bank notes and the tip ends in the taking-in direction of bank notes taken in while the tip ends in the taking-in direction thereof are being stopped, and a stopper driving portion for driving the stopper to advance and retreat between the advanced position and retreated position of the stopper; a bank note arrival detecting portion, which is provided in the conveying passage, for detecting that bank notes identified by the bank note identification portion arrives in the vicinity of the bank note accumulating portion; and a controlling portion for controlling the accumulating stacker driving portion so that, when taking in the bank notes, the upper surface position of the accumulated bank notes is located at a constant height, and simultaneously controlling the stopper driving portion on the basis of identification of bank notes by the bank note identification portion and detection of bank notes by the bank note arrival detecting portion.

With such a construction, since at least one stopper that can advance from upward between the tip end regulating wall and the rear end regulating wall and stop the tip ends in the taking-in direction of bank notes being taken in, whose length in the taking-in direction of the bank notes is shorter than the maximum length, is vertically supported, and is simultaneously pressed the same in the downward direction, the stopper that has advanced to the advancing position is changed over to a state where the stopper is brought into contact with the upper surface of the accumulated bank notes in response to the length in the taking-in direction of the accumulated bank notes and stops the tip end in the taking-in direction of bank notes taken in while pressing the upper surface thereof and a state where the stopper advances the tip end side in the taking-in direction of already accumulated bank notes and stops the tip end in the taking-in direction of the bank notes to be taken in while stopping the tip end of the already accumulated bank notes. Therefore, the stopper is capable of securely stopping the tip ends in the taking-in direction of bank notes having dimensional differences and of securely accumulating bank notes on the basis of the tip ends in the taking-in direction of the bank notes having dimensional differences. Further, since the bank notes having dimensional differences are securely accumulated on the basis of the rear ends in the taking-in direction thereof, it is possible to securely take out the accumulated bank notes sheet by sheet.

The accumulating device according to a fifth aspect of the invention is featured, in addition to the accumulating device according to the fourth aspect, in that the retreat position of the stopper is made into the same position when taking in and taking out bank notes, and simultaneously is a position close to the tip end regulating wall outside the accumulating space.

With such a construction, the retreat position of the stopper is made into the same position when bank notes are taken in and taken out, and at the same time, is located in the vicinity of the tip end regulating wall outside the accumulating space. Therefore, the structure is made simple and inexpensive.

The accumulating device according to a sixth aspect of the invention is featured, in addition to the fourth aspect, in that the retreat position of the stopper is made into two positions differing from each other when taking in and taking out bank notes, and simultaneously the retreat position in taking out bank notes is greatly retreated from the retreat position in taking in bank notes and is outside the accumulating space.

And, with such a construction, since the retreat position of the stopper is made into two positions differing from each other when taking in and taking out bank notes, and at the same time, the retreat position in taking-out is further set back than the retreat position in taking-in and is located outside the accumulating space, advancing and retreating movements of the stopper in taking in bank notes are quickened, and simultaneously the stopper does not cause any hindrance in taking-out movement when taking out bank notes.

The accumulating device according to a seventh aspect of the invention is featured, in addition to any one of the fourth aspect through the sixth aspect, in that the tip end regulating wall is provided with an openable door through which the bank notes on the accumulating stacker can be collectively taken out.

And, with such a construction, by opening the door of the tip end regulating wall, bank notes that are accumulated on the accumulating stacker can be collectively taken out.

A circulating type bank note depositing and dispensing machine capable of depositing and dispensing bank notes and circulatively using the deposited bank note as dispensing bank notes, according to an eighth aspect of the invention, comprises the accumulating device, which is described in any one of the fourth aspect through the sixth aspect, in a temporary storage portion for temporarily and collectively storing the deposited bank notes.

And, since the construction is provided with an accumulating device, according to any one of the fourth aspect to the sixth aspect, at the temporary storage portion in which deposited bank notes are collectively and temporarily stored, it becomes possible to collectively and temporarily store the bank notes having dimensional differences by taking-in and taking-out the temporarily stored bank notes having dimensional differences reliably.

The circulating type bank note depositing and dispensing machine according to a ninth aspect of the invention is featured, in addition to the eighth aspect, in that the tip end regulating wall of the accumulating device is provided with an openable door, temporarily stored bank notes are taken out from said accumulating space portion and received said conveying passage by the taking-in and taking-out means when the depositing is approved, and the temporarily stored bank notes are collectively taken out by opening the door when the depositing is not approved.

With such a construction, when depositing is approved, the temporarily stored bank notes accumulated in the accumulating device are taken out and received sheet by sheet by the taking-in and taking-out means, and when the depositing is not approved, the temporarily stored bank notes can be collectively and quickly returned by opening the door of the tip end regulating wall.

PREFFERED EMBODIMENT OF THE INVENTION

Hereinafter, a description is given of an embodiment of the invention with reference to the accompanying drawings.

Figure 6:
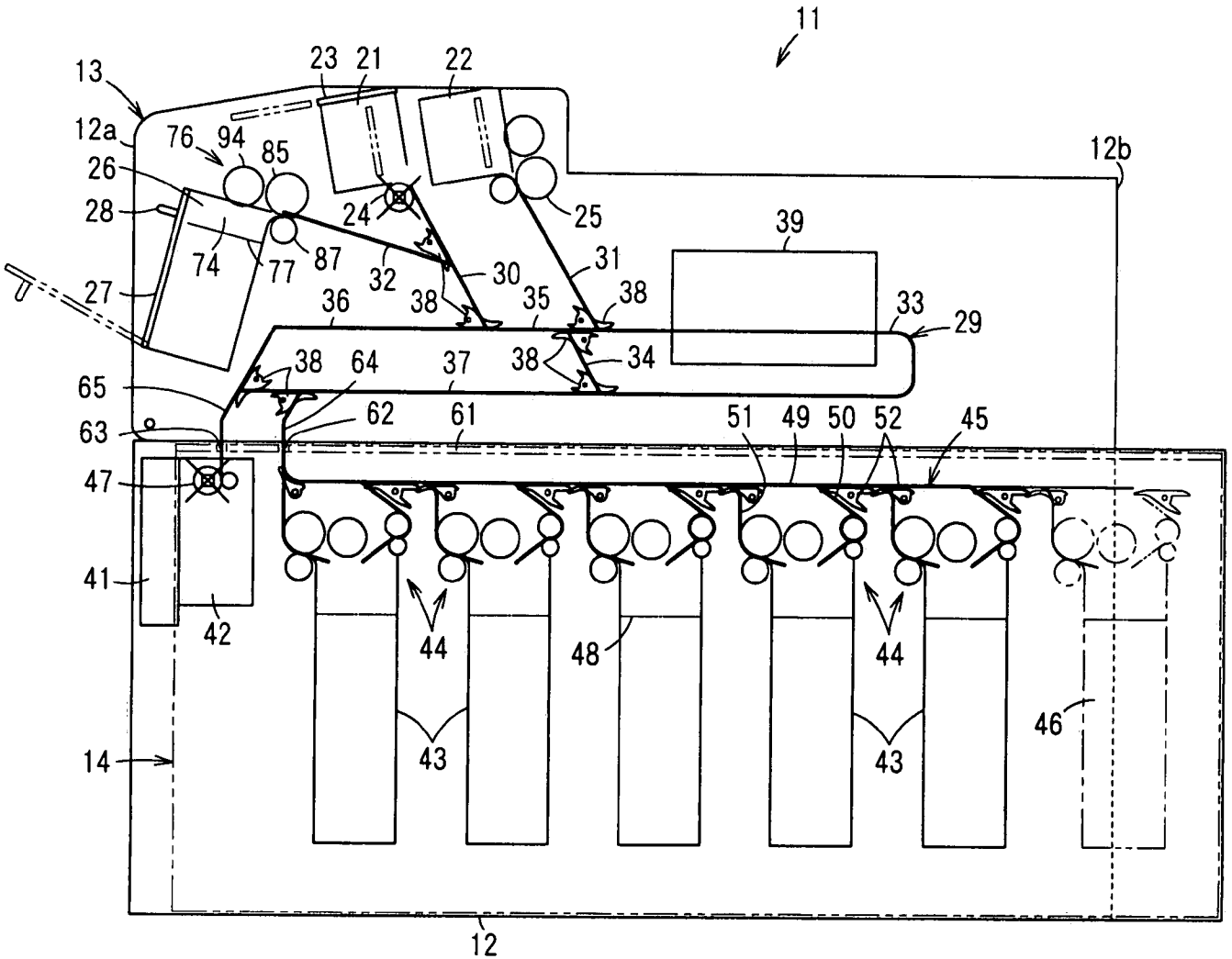
FIG. 6 is a rough side elevational view of a circulating type bank note depositing and dispensing machine using the same accumulating device.

FIG. 6 shows a circulating type bank note depositing and dispensing machine 11, capable of depositing and dispensing bank notes as sheets or the like, in which deposited bank notes can be circulatively used as dispensing bank notes.

Where it is assumed that, in the machine body 12 of the circulating type bank note depositing and dispensing machine 11, the operation side for operating the circulating type bank note depositing and dispensing machine 11 is regarded to be the front side 12*a*, and the side opposite to the operating side, that is, the side opposite to the front side 12*a* is regarded to be rear side 12*b*, the machine 11 is composed to be longitudinal so that the cross width in the left and right direction is narrow, the longitudinal length in the forward and backward direction is long, and the height in the vertical direction is high. The machine body 12 is provided with an upper structure unit 13 and a lower structure unit 14, which can be drawn out from the front side 12*a* of the machine body 12.

A bank note dispensing port 21 for dispensing bank notes and a bank note depositing port 22 for depositing bank notes are formed in order from the front side at the upper front side area of the upper structure unit 13. The bank note dispensing port 21 and bank note depositing port 22 are capable of receiving and storing bank notes in an erect state and with the short side of rectangular bank notes placed in the vertical direction. A transparent shutter 23 that closes the bank note dispensing port 21 when dispensing bank notes and opens after the dispensing is completed is disposed at the bank note dispensing port 21, and at the same time, a taking-in means 24 for taking in bank notes sheet by sheet in the bank note dispensing port 21 is disposed thereat. A taking-out means 25 for taking out, sheet by sheet, bank notes which are inputted into the bank note depositing port 22, into the machine body 12 is disposed at the bank note depositing port 22.

The front side area of the upper structure unit 13 is provided with a temporary storage portion 26 that receives deposited bank notes which are approved to be authentic, that is, authentic deposited bank notes, and collectively and temporarily stores the same in a mixed state. A transparent door 27 which is locked by an electromagnetic lock (not illustrated) in a closed state is disposed at the front side of the temporary storage portion 26 so as to be openable and closable, and the electromagnetic lock is unlocked when returning the temporarily stored bank notes, and the door 27 is opened forward from the front side opening (not illustrated) open to the front side 12*a* of the machine body 12 by holding and pulling a handle 28 attached to the door 27, wherein the temporarily stored bank notes in the temporary storage portion 26 can be collectively taken out when the depositing is not approved.

A bank note conveying portion 29 of an upper structure unit 13 is provided as a conveying passage which is connected to the bank note dispensing portion 21 of an upper structure unit, bank note depositing portion 22 and temporary storage portion 26 and conveys bank notes. The bank note conveying portion 29 of an upper structure unit includes a dispensing conveying passage 30 for conveying bank notes to the bank note dispensing portion 21, a depositing conveying passage 31 for conveying bank notes taken out from the bank note depositing portion 22, a storage conveying passage 32, connected midway at the dispensing conveying passage 30, for conveying bank notes between there and the temporary storage portion 26, an identification conveying passage 33 which is folded back from rearward to frontward to be roughly U-shaped and has one end at the upper side thereof connected to the depositing conveying passage 31, a bypass conveying passage 34 for connecting one end at the upper side of the identification conveying passage 33 to the other end at the lower side thereof, a stored bank note dispensing conveying passage 35 connected between the dispensing conveying passage 30 and one end (the upper end of the bypass conveying passage 34) at the upper side of the identification conveying passage 33, a reject bank note conveying passage 36 connected to the stored bank note dispensing conveying passage 35 and extending forward thereof, and a received bank note dispensing conveying passage 37 which is connected to the other end at the lower side (the lower end of the bypass conveying passage 34) of the identification conveying passage 33, extends forward, and has its front end connected to the reject bank note conveying passage 36. At least the dispensing conveying passage 30, stored conveying passage 32, identification conveying passage 33, stored bank note dispensing conveying passage 35 and received bank note dispensing conveying passage 37 are capable of reversing the conveying direction of bank notes. Changing members 38 for switching the advancing direction of bank notes are provided at the connections among the respective conveying passages 30 through 37. A bank note identification portion 39 is disposed in the identification conveying passage 33 as an information detection portion pertaining to the length in the taking-in direction, which identifies authenticity and denomination of bank notes to be conveyed.

Also, a detachable box 41 that stores exchange tickets is detachably disposed at the front side area of the machine body 12 in the lower structure unit 14, and simultaneously a reject box 42 that stores rejected bank notes is fixedly disposed thereat. Further, the denominated bank note storage portions 43 that stores bank notes per denomination are arranged in the forward and backward direction and fixedly disposed at the rear side area of the reject box 42, and receiving and taking-out means 44 that receive bank notes and takes out the same sheet by sheet is disposed at the upper part of the respective denominated bank note storage portions 43. Also, unit bank note conveying portion 45 of the lower structure that is connected to the respective receiving and taking-out means 44 and conveys the bank notes is disposed at the upper part of the denominated bank note storage portions 43. In addition, an extension space 46 capable of expanding the denominated bank note storage portions 43 as necessary is formed at the extreme rear part of the lower structure unit 14.

A taking-in means 47 that takes in bank notes from the upper part of the reject box 42 is disposed in the reject box 42.

An accumulating stacker 48 is provided so as to be elevated and lowered in the respective denominated bank note storage portions 43 and accumulates bank notes on the accumulating stacker 48 in the vertical direction.

A bank note conveying portion 45 of the lower structure unit is provided with a main conveying passage 49 which is disposed in the forward and backward direction along the upper area of the denominated bank note storage portion 43, a taking-in conveying passage 50 for conveying bank notes taken in the respective denominated bank note storage portions 43 from the main conveying passage 49, and a taking-out and conveying passage 51 for conveying bank notes, which are taken out from the respective denominated bank note storage portions 43, onto the main conveying passage 49. A changing member 52 that changes over the advancing direction of bank notes is disposed at connection portions between the respective conveying passages 49 through 51, respectively. The main conveying passage 49 of the lower structure unit bank note conveying portion 45 is able to reverse the conveying directions of bank notes.

And, when taking in bank notes into the respective denominated bank note storage portions 43, the bank notes are accumulated and stored on the accumulating stacker 48, and the accumulating stacker 48 is gradually lowered as the upper surface height of the bank notes is increased in line with receiving and storing the bank notes, wherein the upper surface height on which the bank notes are received and accumulated and stored can be kept constant within a fixed range. Also, when taking out bank notes from the denominated bank note storage portions 43, the accumulating stacker 48 is elevated, and the bank notes on the accumulating stacker 48 are taken out sheet by sheet by the receiving and taking-out means 44.

Also, a plate-shaped covering member 61 that covers up the upper surface of the lower structure unit 14, which is housed in the machine body 12, in a closed state is fixed between the upper structure unit 13 and the lower structure unit 14 in the machine body 12. The first opening 62 and second opening 63 are, respectively, formed at the front end side of the covering member 61. The first connection passage 64 that connects the front end side of the received bank note dispensing conveying passage 37 unit bank note conveying portion 29 of the upper structure and the front end side bank note conveying portion 45 of the lower structure unit to each other and conveys bank notes is disposed in the first opening 62. The second connection passage 65 that connects the reject bank note conveying passage 36 of the upper structure unit bank note conveying portion 29 and the reject box 42 to each other and conveys bank notes is disposed in the second opening 63. The first connection passage 64 and second connection passage 65 are connected to each other, through the first opening 62 and second opening 63 of the covering member 61 fixed on the machine body 12 side, in a state where the upper structure unit 3 and lower structure unit which are drawable with respect to the machine body 12 are housed in the machine body 12, and are capable of conveying bank notes between the upper structure unit 13 and the lower structure unit 14. Further, the first connection passage 64 and the second connection passage 65 are capable of reversing the conveying direction of bank notes.

Next, FIG. 1 through FIG. 4 show an accumulating device 71 which is applied to the temporary storage portion 26 of the circulating type bank note depositing and dispensing machine 11 and accumulates bank notes P in a mixed state as sheets or the like having dimensional differences. The accumulating device 71 is provided with a bank note accumulating portion 72 as a portion for accumulating sheets or the like, wherein the bank notes P are taken sheet by sheet from the storage conveying passage 32 in the bank note accumulating portion 72 through a taking-in and taking-out port 73 operating as a taking-in port provided at the rear upper end of the bank note accumulating portion 72, and at the same time, the bank notes P are taken from the bank note accumulating portion 72 to the storage conveying passage 32 sheet by sheet. The taking-in and taking-out directions of the bank notes P with respect to the bank note accumulating portion 72 are set to a short-side direction of the bank notes P.

The bank note accumulating portion 72 includes an accumulating frame portion 75 having an accumulating space portion 74 which accumulates bank notes P, a taking-in and taking-out means 76 which takes bank notes P from the storage conveying passage 32 into the accumulating space portion 74 sheet by sheet and simultaneously operates a taking-out means for taking out the bank notes P sheet by sheet as necessary, and an accumulating stacker 77 for accumulating bank notes P taken in the accumulating space portion 74 in the vertical direction, etc. The bank note accumulating portion 72 of the upper structure unit 13 is supported by side frames 78*a* and 78*b* disposed at both sides.

The accumulating frame portion 75 has an upper portion side, which is connected to the storage conveying passage 32 via the taking-in and taking-out port 73, inclined rearwards by, for example, 10 degrees, and accumulates bank notes in the vertical direction in a state where bank notes which are oriented in the vertical direction in the accumulating space portion 74 on the accumulating stacker 77 are inclined rearward. The accumulating frame portion 75 has a rectangular section that can accommodate bank notes P of a maximum size and is formed to be rectangularly tubular, and is provided with a tip end regulating wall 79 for regulating the tip ends in the taking-in direction of bank notes P to be taken in, whose length in the taking-in direction is longest, a rear end regulating wall 80 for regulating the rear ends in the taking-in direction of bank notes P to be taken in, and both-end regulating wall 81 for regulating both the ends in the lengthwise direction of the bank notes P. The tip end regulating wall 79 is separately provided with a door 27 through which the bank notes P in the accumulating space portion 74 can be taken out, or may be composed of the door 27 itself.

The taking-in and taking-out means 76 takes bank notes P, which are transferred from the storage conveying passage 32, onto the accumulating stacker 77 of the accumulating space portion 74 in conjunction with the accumulating stacker 77 that can be elevated and lowered while having the bank notes P stored thereon, and at the same time, takes out the bank notes P accumulated on the accumulating stacker 77 of the accumulating space portion 74 to the storage conveying passage 32. The taking-in and taking-out means 76 includes a rotation shaft 83 rotatably supported on both side frames 78*a* and 78*b* above the taking-in and taking-out port 73 via bearings 82, wherein a plurality of feed rollers 85 and guide rollers 86 are, respectively, attached to the rotation shaft 83 in the axial direction, and a plurality of gate rollers 87 that hold bank notes P between the same and the respective feed rollers 85, convey for taking-in and convey for taking-out, opposite to the respective feed rollers 85 below the taking-in and taking-out port 73.

A blade roller 89 having a plurality of blades 88, which are made of, for example, urethane resin, has a comparatively high friction coefficient, and are resilient and flexible, projecting from the circumference of the roller is disposed between a plurality of gate rollers 87 opposite to the respective guide rollers 86. The blade roller 89 is disposed at the taking-in position being the side portion between the gate rollers 87 when bank notes are taken in and rotates there, and causes the bank notes to be taken in the accumulating space portion 74 by the blades 88 while turning the tip end in the taking-in direction of the bank notes P to the tip end regulating wall 79, and simultaneously, operates so that the rear end in the taking-in direction of the taken-in bank notes P is caused to move along the rear end regulating wall 80. Also, when taking out the bank notes, the blade roller 89 moves from the side position of the gate roller 87 to the downward retreat position and stands by.

A conveying roller 90 for conveying for taking-in and taking-out while holding bank notes P between the same and the feed roller 85 is disposed at the storage conveying passage 32 side opposite to the accumulating space portion 74 at the gate roller 87.

A plurality of levers 92 are swingably and axially supported on the rotation shaft 83 of the feed roller 85 by a plurality of bearings 91, and a rotation shaft 93 is rotatably supported between the tip ends of the levers 92. And, a plurality of taking-out rollers 94 are attached to the rotation shaft 93 in the axial direction. The levers 92 are prevented from downward swinging at a prescribed descent position of the taking-out rollers 94, and are pressed by a spring (not illustrated) in the direction along which the taking-out roller 94 descends.

The rotation shaft 83 of the feed roller 85 is driven and rotated by a motor M2 along with the side bank note conveying portion 29 the upper structure unit including the storage conveying passage 32. The rotation shaft 83 of the feed roller 85 and the rotation shaft 93 of the taking-out roller 94 are driven and rotated in conjunction with each other in the same direction by, for example, a transmission mechanism 95 using a pulley 95*a* and a belt, etc. The feed roller 85 of the rotation shaft 83 has the same diameter as that of the taking-out roller 94 of the rotation shaft 93, wherein the feed roller 85 and the taking-out roller 94 are caused to rotate at the same speed in conjunction with each other. On the circumferential surface of the feed roller 85 and the taking-out roller 94, friction surfaces having a large friction coefficient such as, for example, rubber, and sliding surfaces whose friction is lower than the friction surface are, alternatively, formed in the circumferential direction, and the feed roller 85 and taking-out roller 94 are constructed so that, when taking out bank notes, the friction surfaces of the feed roller 85 and taking-out roller 94 are brought into contact with the bank notes P on the accumulating stacker 77 at roughly the same time and commence the taking-out.

A supporting axis 96 is attached between the side frames 78*a* and 78*b* at both sides above the taking-in and taking-out port 73. At a plurality of points of the supporting axis 96 in the axial direction, ends of a plurality of guiding members 97 at one side thereof, which guide the tip end in the taking-in direction of a bank note P taken from the taking-in and taking-out port 73 in the accumulating space portion 74 onto the upper surface of already accumulated bank notes P on the accumulating stacker 77, are axially supported so as to swing. The respective guiding members 97 are formed of a thin plate of a light material, and are provided with a curved portion 98 which guides the tip end in the taking-in direction of a bank note taken P from the taking-in and taking-out port 73 into the accumulating space portion 74 onto the upper surface of already accumulated bank notes P on the accumulating stacker 77, and a roughly straight pressing portion 99 which is in contact with the upper surface of already accumulated bank notes P and presses the same at the tip end side of the curved portion 98.

A plurality of notched portions 100 for the guiding members and a plurality of notched portions 101 for stoppers are formed on the upper end of the tip end regulating wall 79 of the accumulating frame portion 75. The tip ends of swinging guiding members 97 are caused to advance into the notched portions 100 among the notched portions. At the upper end of the rear end regulating wall 80, a plurality of guiding portions 102, which are positioned between the gate rollers 87 and the blade rollers 89, curved downward of the taking-in and taking-out port 73, and guide the taking-in and taking-out of the bank notes P, are formed.

The accumulating stacker 77 is driven by a motor M1 operating as a drive portion of the accumulating stacker and is elevated and lowered.

Also, a sensor S1 operating as a bank note arrival detecting portion that detects arrival of bank notes P identified by the bank note identification portion 39 at the vicinity of the bank note accumulating portion 72, and a conveying roller 103 for holding the upper and lower sides thereof and conveying bank notes P are disposed in the storage conveying passage 32. In addition, the storage conveying passage 32 is provided with a sensor S2 for detecting the swinging angle of the lever 92 and a sensor S3 for detecting the swinging angle of the guiding member 96.

Figure 2:
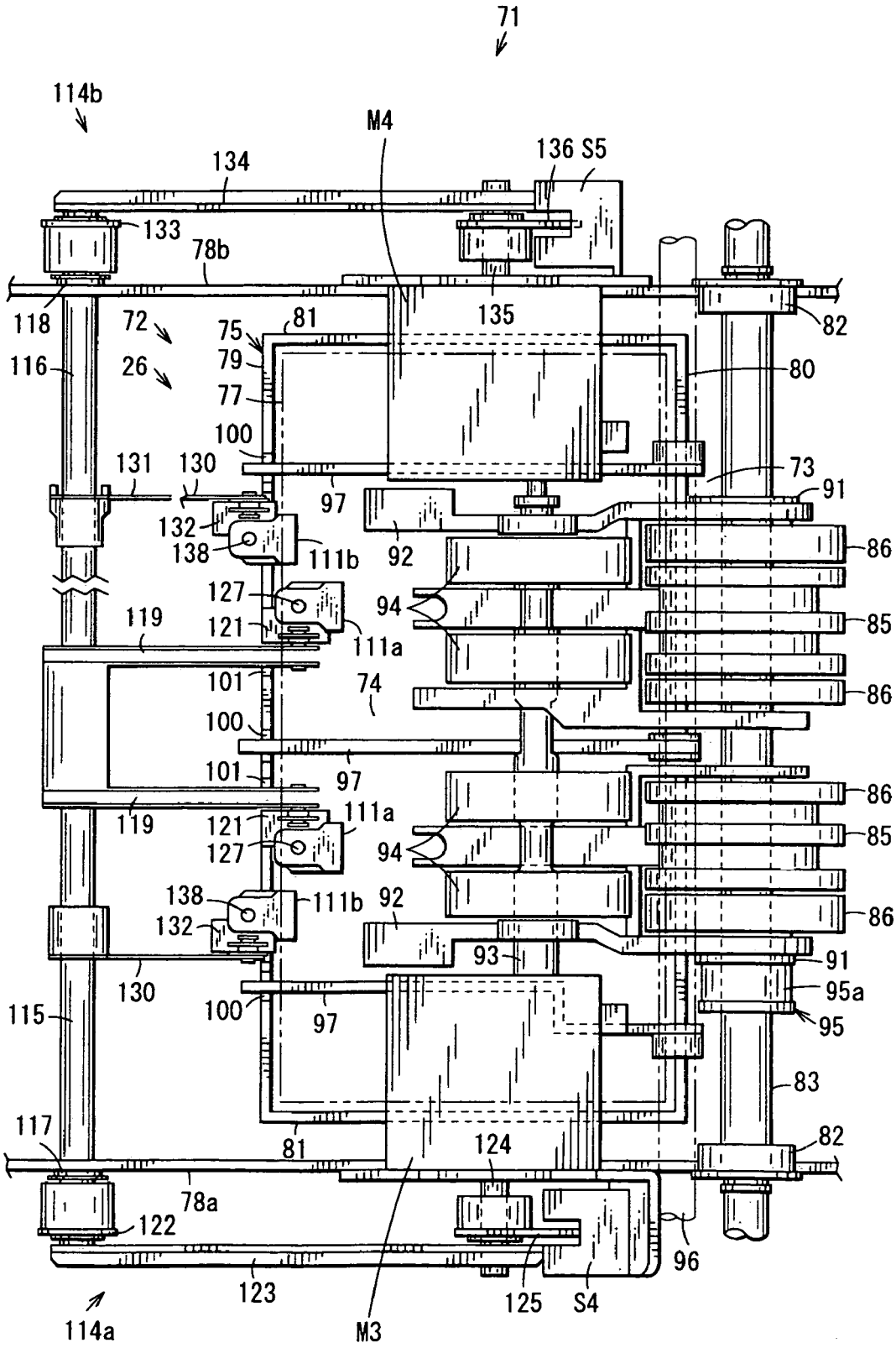
FIG. 2 is a plan view of the same accumulating device.

In addition, the bank note accumulating portion 72 is provided with a plurality of short-width stoppers 111*a* and a plurality of intermediate-width stoppers 111*b*, which operate as stoppers that selectively advance from outward of the accumulating space portion 74 into the accumulating space portion 74, stop the tip ends in the taking-in direction of bank notes P to be taken in, line up the rear ends in the taking-in direction of the bank notes P to the rear end regulating wall 80, and are positioned at the temporary storage position capable of taking out by the taking-in and taking-out means 76. The tip ends in the taking-in direction of the bank notes P are selectively stopped by the stoppers 111*a* and 111*b* on the basis of the bank note width per denomination in the short side direction of the bank notes P by the bank note identification portion 39 and detection of the sensor S1 disposed in the storage conveying passage 32. That is, the denominations of bank notes P are set in advance as groups of short-width bank notes PS whose width in the short-side direction is short, intermediate-width bank notes PM, and long-width bank notes PL, wherein if the denomination of the short-width bank notes PS is identified by the bank note identification portion 39 and detected by the sensor S1, the short-width stopper 111*a* advances from outward of the accumulating space portion 74 into the accumulating space portion 74, stands by for stopping the short-width bank notes PS to be taken in, and similarly, if the denomination of intermediate-width bank notes PM is identified by the bank note identification portion 39 and is detected by the sensor S1, the intermediate-width stopper 111*b* advances from outward of the accumulating space portion 74 into the accumulating space portion 74 and stands by for stopping of the intermediate-width bank notes PM to be taken in. Also, if the denomination of long-width bank notes PL is identified by the bank note identification portion 39 and is detected by the sensor S1, both the stoppers 111*a* and 111*b* remain in a retreated state, and the tip ends in the taking-in direction of the long-width bank notes PL taken in the accumulating space portion 74 are stopped by the tip end regulating wall 79. In addition, for reference, FIG. 2 shows a state where both the stoppers 111*a* and 111*b* have advanced to the advanced position.

The stoppers 111*a* and 111*b* include stopper surfaces 112*a* and 112*b* by which the tip ends in the taking-in direction of the bank notes P are stopped, and attaching lugs 113*a* and 113*b* projecting from the upper edge and intermediate part of the stoppers at the side opposite to the side of the stoppers 112*a* and 112*b* where bank notes are stopped.

The short-width stopper 111*a* and intermediate-width stopper 111*b* are, respectively, provided with a short-width advancing and retreating mechanism 114*a* and an intermediate-width advancing and retreating mechanism 114*b*, which operate as an advancing and retreating mechanism caused to advance between the tip end regulating wall 79 and the rear end regulating wall 80 in the bank note accumulating portion 72 and caused to advance and retreat between the advanced position at which the tip ends in the taking-in direction of bank notes P to be taken in and the position retreated from the advanced position.

Vertical supporting axes 115 and 116 are juxtaposed in parallel to the outer surface of the tip end regulating wall 79 at the position opposed to the outer surface of the tip end regulating wall 79, and both ends of the vertical supporting axes 115 and 116 are axially supported on the side frames 78*a* and 78*b* at both sides by bearings 117 and 118.

Figure 3:
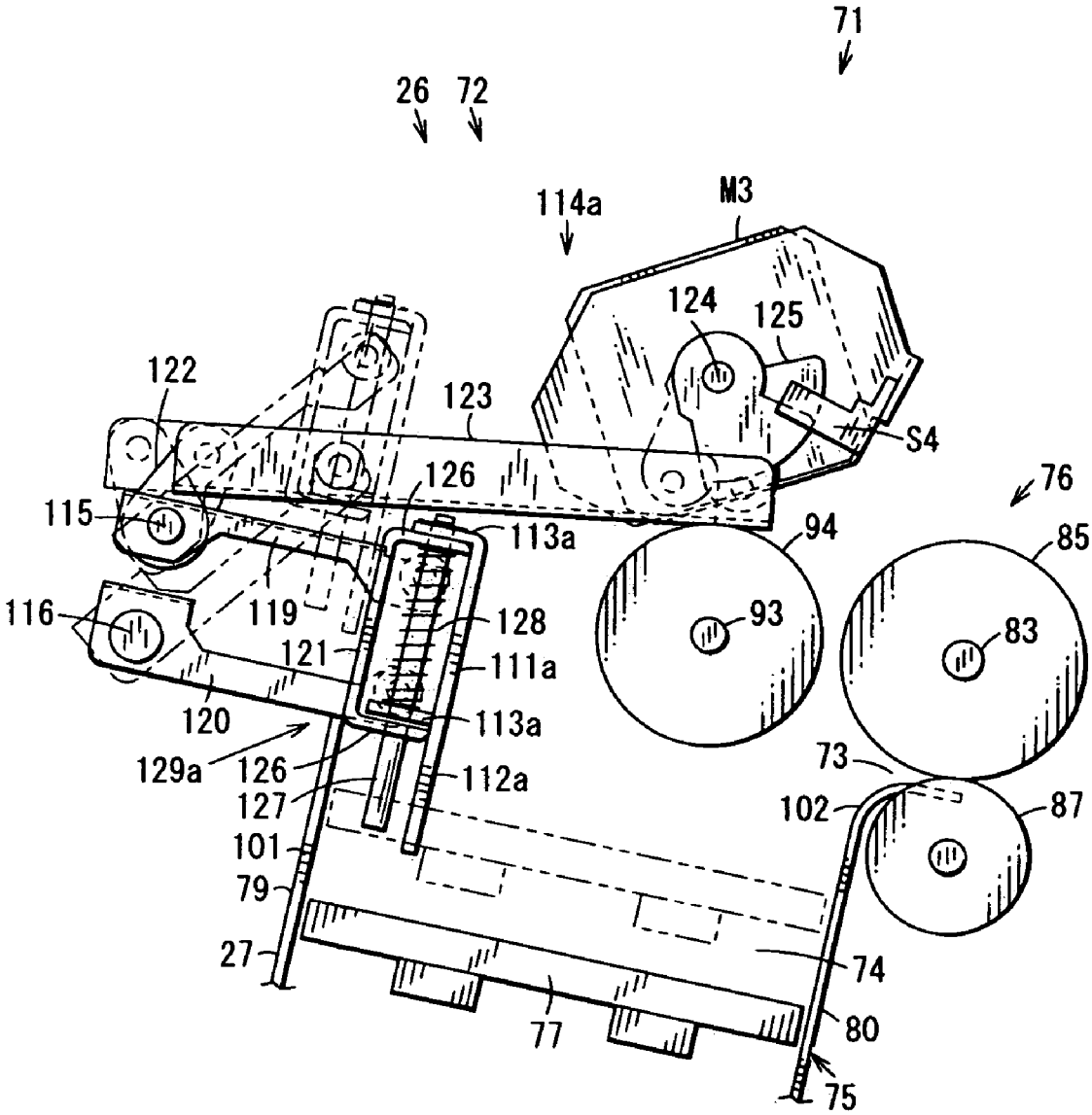
FIG. 3 is a side elevational view showing a configuration related to a short-width stopper of the same accumulating device.

As shown in FIG. 2 and FIG. 3, the short-width advancing and retreating mechanism 114*a* has one end of an upper side link 119 fixed on the upper side supporting axis 115 and one end of a lower side link 120 rotatably and axially supported on the lower side supporting axis 116 and has the other ends of the respective links 119 and 120 rotatably and axially supported on a supporting member 121, and the short-width stopper 111*a* is attached to the supporting member 121. That is, a parallel link structure is employed by the links 119 and 120 and the supporting member 121, and the short-width stopper 111*a* vertically moves, along with the supporting member 121, by swinging of the respective links 119 and 120 centering around the respective supporting members 115 and 116 while moving in parallel between the advanced position shown with a solid line in FIG. 3 and the retreated position shown with a two-dashed chain line shown in the same drawing. The advanced position of the short-width stopper 111*a* is determined so that the interval between the stopper 111*a* and the rear end regulating wall 80 corresponds to the width in the taking-in direction of the short-width bank notes PS, and the retreated position of the short-width stopper 111*a* is made into the same position when being taken in and taken out, and the position is in the vicinity of the tip end regulating wall 79 outside the accumulating space portion 74.

At the outside of one side frame 78*a*, a lever 122 is attached to the end of the upper side supporting axis 115, and one end of the link 123 is rotatably and axially supported at the tip end of the lever 122. A motor M3 is attached to the inside of one side frame 78*a* as a stopper drive portion, corresponding to the position of the other end of the link 123. A cam 125 is attached to the outside of one side frame 78*a* on the drive shaft 124 of the motor M3, and the other end of the link 123 is rotatably and axially supported on the cam 125. A sensor S4 which is disposed at both side areas of the cam 125 detects the position of the short-width stopper 111*a* by detecting the rotating position of the cam 125. The sensor S4 is shielded by the cam 125 from light in a state where the short-width stopper 111*a* is positioned at the position advanced from the retreated position, and the shielding effected by the cam 125 is cancelled in a state where the short-width stopper 111*a* is positioned at its retreated position, wherein light penetration is made available. In regard to detection of the advanced position of the short-width stopper 111*a*, the short-width stoppers 111*a* at the retreated position commences to move to the advancing position by drive of the motor M3, and the time of elapse since the shielding of the sensor S4 from light by the cam 125 is measured, whereby it is detected that the short-width stopper 111*a* has arrived at the advanced position at the moment when a preset time elapses. The retreated position of the short-width stopper 111*a* is detected at the moment when the shielding of the sensor S4 by the cam 125 is cancelled, that is, the cam 125 is located at the position shown with a two-dashed chain line in FIG. 3.

A supporting lug 126 is formed at the upper and lower ends on the supporting member 121 to which the short-width stopper 111*a* is attached. The upper and lower attaching lugs 113*a* of the short-width stoppers 111*a* are disposed on the respective upper surfaces of the upper and lower supporting lugs 126, and an axis 127 is disposed so as to pass through the supporting lugs 126 and attaching lugs 113*a*. The axis 127 is fixed at the attaching lug 113*a* and is slidable in the vertical direction with respect to the supporting lug 126. A spring 128 operating as a pressing means is disposed between the upper side supporting lug 126 and the lower side attaching lug 113*a* and presses the short-width stopper 111*a* downward with respect to the supporting member 121. However, the pressing force is set to a very weak level, and the stopper supporting means 129*a* that supports the short-width stopper 111*a* is composed of the supporting member 121, axis 127 and a spring 128. That is, the stopper supporting means 129*a* is selectively changed over to a state where the stopper supporting means 129*a* vertically movably supports the short-width stopper 111*a* and presses the same downward, and stops the tip ends in the taking-in direction of bank notes P to be taken in while being brought into contact with the upper surface of already accumulated bank notes P in response to the length in the taking-in direction of the accumulated bank notes P and pressing the upper surface thereof, and a state where the stopper supporting means 129*a* advances to the tip end side in the taking-in direction of already accumulated bank notes P and stops the tip ends in the taking-in direction of the bank notes P to be taken in while stopping the tip ends in the taking-in direction of the already accumulated bank notes P.

Figure 4:
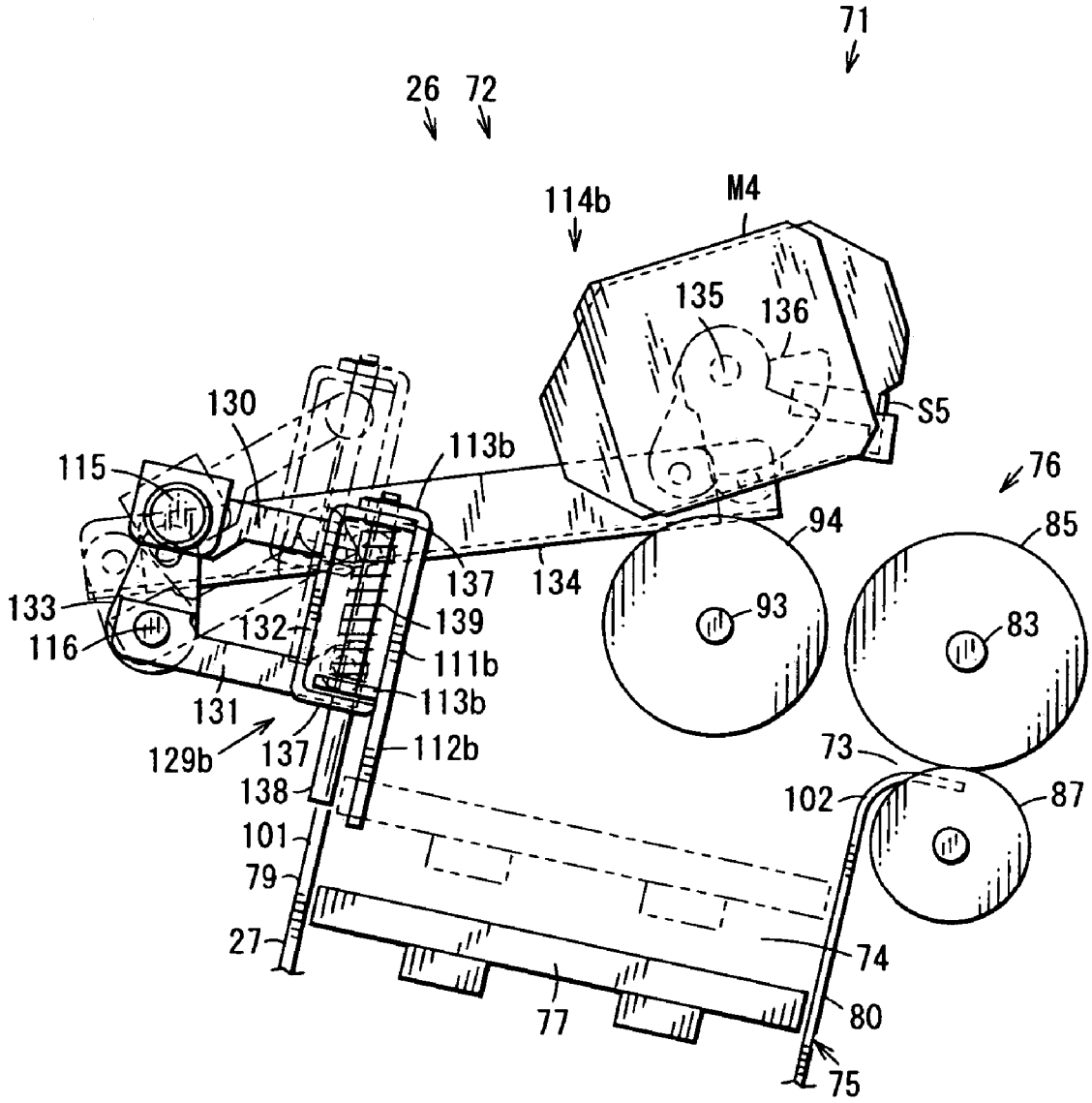
FIG. 4 is a side elevational view showing a configuration related to an intermediate-width stopper of the same accumulating device.

As shown in FIG. 2 and FIG. 4, the intermediate-width advancing and retreating mechanism 114*b* has one end of an upper side link 130 rotatably and axially supported on the upper side supporting axis 115, one end of a lower-side link 131 fixed on the lower side supporting axis 116, and the other ends of the respective links 130 and 131 rotatably and axially supported on the supporting member 132. The intermediate-width stopper 111*b* is attached to the supporting member 132. That is, a parallel link structure is employed by the links 130, 131 and supporting member 132, and the intermediate-width stopper 111*b* vertically moves, along with the supporting member 132, by swinging of the respective links 130 and 131 centering around the respective supporting axes 115 and 116, while the intermediate-width stopper 111*b* parallelly moves between the advanced position shown by a solid line in FIG. 4 and the retreated position shown with a two-dashed chain line in the same drawing. The advanced position of the intermediate-width stopper 111*b* is determined at a position where the interval between the stopper 111*b* and the rear end regulating wall 80 corresponds to the width in the taking-in direction of the intermediate-width bank notes PM, and the retreated position of the intermediate-width stopper 111*b* is determined at the same position when being taken in and taken out, and is in the vicinity of the tip end regulating wall 79 outside the accumulating space portion 74.

A lever 133 is attached to the end portion of the lower side supporting axis 116 outside the other side frame 78*b*, and one end of the link 134 is rotatably and axially supported at the tip end of the lever 133. A motor M4 operating as a stopper drive portion is attached to the inside of the other side frame 78*b*, corresponding to the other end position of the link 134, and a cam 136 is attached to the outside of the other side frame 78*b* on the drive shaft 135 of the motor M4, wherein the other end of the link 134 is rotatably and axially supported on the cam 136. A sensor S5 is disposed at both side areas of the cam 136 and detects the rotating position of the cam 136, whereby the position of the intermediate-width stopper 111*b* can be detected. The sensor M5 is shielded by the cam 136 from light in a state where the intermediate-width stopper 111*b* is located outside the retreated position, and the shielding effected by the cam 136 is cancelled in a state where the intermediate-width stopper 111*b* is located at the retreated position, wherein light penetration is made available. In regard to detection of the advanced position of the intermediate-width stopper 111*b*, the intermediate-width stopper 111*b* at the retreated position commences to move to the advancing position by drive of the motor M4, and the time of elapse since the shielding of the sensor S5 from light by the cam 136 is measured, whereby it is detected that the intermediate-width stopper 11*b* has arrived at the advanced position at the moment when a preset time elapses. The retreated position of the intermediate-width stopper 111*b* is detected at the moment when the shielding of the sensor S5 by the cam 136 is cancelled, that is, the cam 136 is located at the position shown with a two-dashed chain line in FIG. 4.

A supporting lug 137 is formed at the upper and lower ends on the supporting member 132 to which the intermediate-width stopper 111*b* is attached. The upper and lower lugs 113*b* of the intermediate-width stoppers 111*b* are disposed on the upper and lower supporting lugs 137, and an axis 138 is disposed so as to pass through the supporting lugs 137 and attaching lugs 113*b*. The axis 138 is fixed at the attaching lug 113*b* and is slidable in the vertical direction with respect to the supporting lug 137. A spring 139 operating as a pressing means is disposed between the upper side supporting lug 137 and the lower side attaching lug 113*b* and presses the intermediate-width stopper 111*b* downward with respect to the supporting member 132. However, the pressing force is set to a very weak level, and the stopper supporting means 129*b* that supports the intermediate-width stopper 111*b* is composed of the supporting member 132, axis 138 and a spring 139. That is, the stopper supporting means 129*b* is selectively changed over to a state where the stopper supporting means 129*b* vertically movably supports the intermediate-width stopper 111*b* and presses the same downward, and stops the tip ends in the taking-in direction of bank notes P to be taken in while being brought into contact with the upper surface of already accumulated bank notes P in response to the length in the taking-in direction of the accumulated bank notes P and pressing the upper surface thereof, and a state where the stopper supporting means 129*b* advances to the tip end side in the taking-in direction of already accumulated bank notes P and stops the tip ends in the taking-in direction of the bank notes P to be taken in while stopping the tip ends in the taking-in direction of the already accumulated bank notes P.

Figure 5:
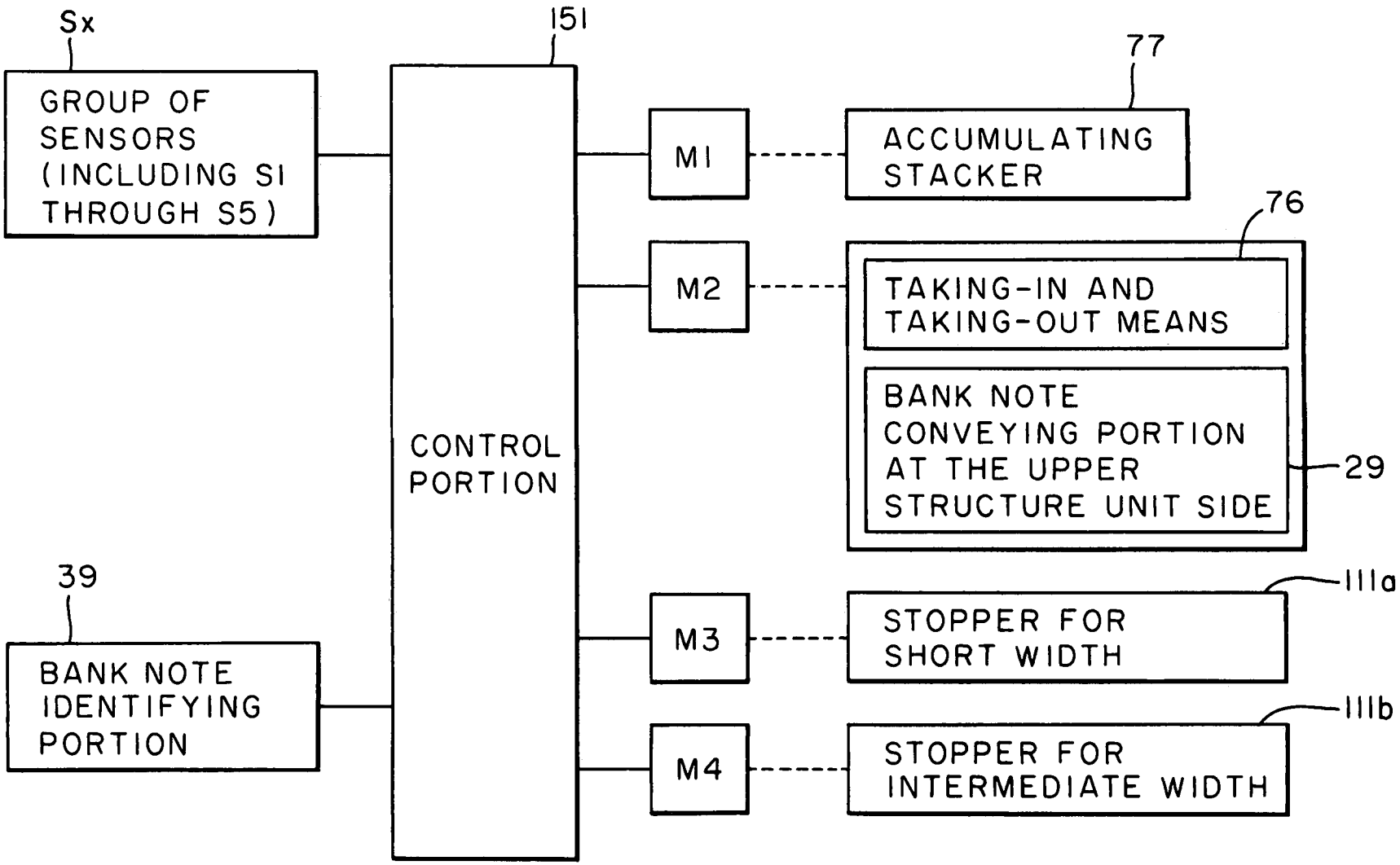
FIG. 5 is a block diagram of a control system of the same accumulating device.

Next, FIG. 5 shows a block diagram of a control system of the accumulating device 71. The accumulating device 71 is provided with a controlling portion 151 to which a group of sensors Sx including the respective sensors S1 through S5, the bank note identification portion 39, motor M1 for elevating and lowering the accumulating stacker 77, motor M2 for normally and reversely rotating unit bank note conveying portion 29 of the upper structure including the taking-in and taking-out means 76 and storage conveying passage 32, motor M3 for causing the short-width stopper 111*a* to advance and retreat, and motor M4 for causing the intermediate-width stopper 111*b* to advance and retreat are connected.

The controlling portion 151 has a function of lowering the accumulating stacker 77 by controlling the motor M1 so that, when taking in bank notes, the upper surface position of accumulated bank notes P is positioned on a fixed taking-in height, and at the same time, has a function of causing the stoppers 111*a* and 111*b* to advance and retreat by controlling the motors M3 and M4 based on identification of bank notes P by the bank note identification portion 39 and detection of bank notes P by the sensor S1 which is the bank note arrival detection portion.

Next, a description is given of actions of the present embodiment.

First, in FIG. 6, a depositing process operation and a dispensing process operation in the circulating type depositing and dispensing machine 11 are described.

When a depositing process is carried out, deposited bank notes P are inputted into the bank note depositing port 22 in an erect state, and a depositing process is commenced by operating a depositing start by using the high-rank terminal of the circulating type depositing and dispensing machine 11.

The deposited bank notes P inputted in the bank note depositing port 22 are taken out sheet by sheet from the bank note depositing port 22 onto the depositing conveying passage 31 bank note conveying portion 29 of the upper structure unit, and are conveyed to the identification conveying passage 33, wherein the bank notes are identified by the bank note identification portion 39.

Deposited bank notes P that are identified to be authentic by the bank note identification portion 39 are taken from the identification conveying passage 33 into the accumulating space portion 74 of the temporary storage portion 26 through the bypass conveying passage 34, stored bank note dispensing conveying passage 35, dispensing conveying passage 30 and storage conveying passage 32 and are temporarily stored therein. Since the front side door 27 that opens and closes the accumulating space portion 74 of the temporary storage portion 26 is made transparent, it is possible to visibly observe the state of bank notes P accumulated in the accumulating space portion 74 from outside.

Deposited bank notes P that are not identified by the bank note identification portion 39, that is, unidentified bank notes P are taken from the identification conveying passage 33 into the bank note dispensing port 21 in an erect state through the bypass conveying passage 34, stored bank note dispensing conveying passage 35 and dispensing conveying passage 30. And, the transparent shutter 23 is opened at the moment when the temporary storage of the deposited bank note is terminated, and the bank notes are returned to the customer.

And, when a process to temporary storage of all the deposited bank notes P inputted in the bank note depositing port 22 is completed, the result of identification is displayed, and approval or non-approval of the depositing is confirmed.

When the depositing is approved, a receiving action of the bank notes P temporarily stored in the temporary storage portion 26 is commenced. The temporarily stored bank notes P of the temporary storage portion 26, that is, the received bank notes P are taken out sheet by sheet from the temporary storage portion 26 onto the storage conveying passage 32, and are conveyed to the identification conveying passage 33 through the dispensing conveying passage 30 and stored bank note dispensing conveying passage 35, wherein the received bank notes P are identified by the bank note identification portion 39. The received bank notes P identified to be authentic by the bank note identification portion 39 are conveyed from the received bank note dispensing conveying passage 37 into the main conveying passage 49 bank note conveying portion 45 of the lower structure unit through the first connection passage 64, taken in the corresponding denominated bank note storage portion 43 from the main conveying passage 49 through the corresponding denominated bank note taking-in conveying passage 50, and accumulated and stored therein.

When the depositing is not approved, the electromagnetic lock that locks the door 27 of the temporary storage portion 26 is unlocked. Therefore, the handle 28 of the door 27 is held, and the door is opened forward of the machine body 12, wherein the temporarily stored bank notes P in the accumulating space portion 74 of the temporary storage portion 26 is collectively taken out, and the door 27 is closed.

Also, when the dispensing is processed, dispensing information such as the amount, etc., including the denomination and sheets of dispensing bank notes is inputted by a high-rank terminal of the circulating type bank note depositing and dispensing machine 11, and a dispensing operation is carried out, wherein a dispensing process is commenced.

Wherein a single denomination of bank notes P is dispensed, bank notes P are taken out sheet by sheet in order from only the denominated bank note storage portion 43 corresponding thereto, and where a plurality of denominations of bank notes P are dispensed, bank notes P are taken out sheet by sheet in the predetermined order of denomination in such a manner that bank notes P are taken out sheet by sheet in order from the denomination bank note storage portion 43 corresponding to a certain single denomination, and after the taking-out is completed, another denomination of bank notes P are taken out sheet by sheet in order from the next denominated bank note storage portion 43.

The bank notes P taken out from the denominated bank note storage portions 43 are conveyed from the taking-out conveying passage 51 and main conveying passage 49 into the received bank note dispensing conveying passage 37 bank note conveying portion 29 of the upper structure unit and the identification conveying passage 33 through the first connection passage 64, and are identified by the bank note identification portion 39.

The bank notes P identified to be authentic by the bank note identification portion 39 are taken from the identification conveying passage 33 into the bank note dispensing port 21 through the stored bank note dispensing conveying passage 35 and dispensing conveying passage 30 and are accumulated in an erect state.

Bank notes p identified not to be authentic by the bank note identification portion 39 are taken from the identification conveying passage 33 into the stored bank note dispensing conveying passage 35 and from the reject bank note conveying passage 36 into the reject box 42 of the lower structure unit 14 through the second connection passage 65, and are received therein.

After the dispensing bank notes P corresponding to the dispensing amount are taken in the bank note dispensing port 21 and accumulated therein, the transparent shutter 23 is opened. After the dispensing bank notes P are taken out from the bank note dispensing port 21, the transparent shutter 23 is closed.

Next, a description is given of actions of the accumulating device 71 that compose the temporary storage portion 26 of the circulating type bank note depositing and dispensing machine 11.

Where bank notes are taken in and accumulated in the accumulating space portion 74 of the accumulating device 71, the blade roller 89 moves to the taking-in position which is the side portion position between the gate rollers 87. The stoppers 111*a* and 111*b*, respectively, stand by at the retreat position, and are selectively caused to advance to and retreat from the retreated position to the advanced position in response to identification by the bank note identification portion 39 and detection by the sensor S1.

And, in a case where the bank notes P identified by the bank note identification portion 39 and detected by the sensor S1 are short-width bank notes PS when the bank notes are accumulated, that is, when deposited bank notes are temporarily stored, the short-width stopper 111*a* is caused to advance from the retreated position to the advanced position by drive of the motor M3.

Figure 7:
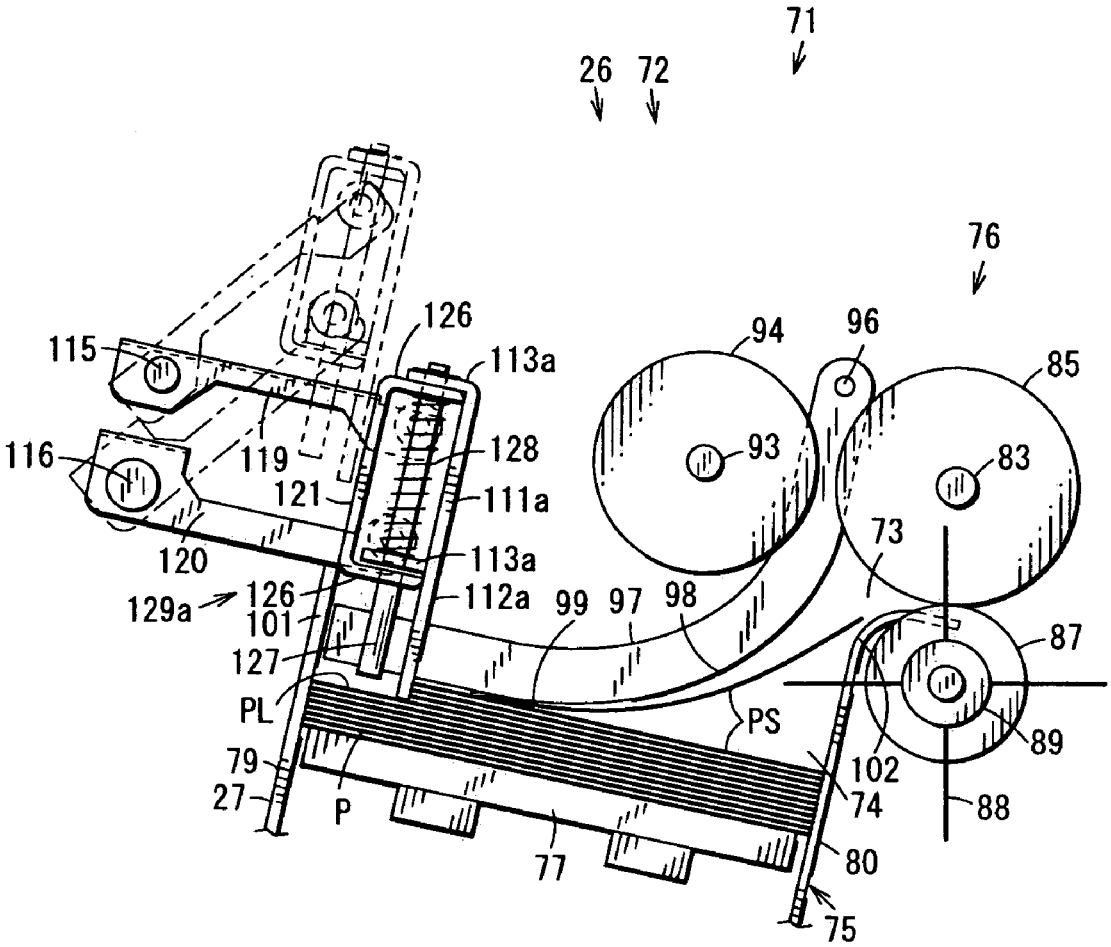
FIG. 7 is a view describing a first mode in which short-width bank notes are stopped by the short-width stopper of the same accumulating device.

At this time, as shown in FIG. 7, where more short-width bank notes PS are accumulated in an upper part area of the bank notes P accumulated on the accumulating stacker 77 in the accumulating space portion 74, the lower part of the short-width stopper 111*a* is caused to advance to the tip end side in the taking-in direction of the accumulated short-width bank notes PS and stands by for stopping of short-width bank notes PS planned to be taken in while stopping the tip ends in the taking-in direction of the accumulated short-width bank notes PS.

Figure 1:
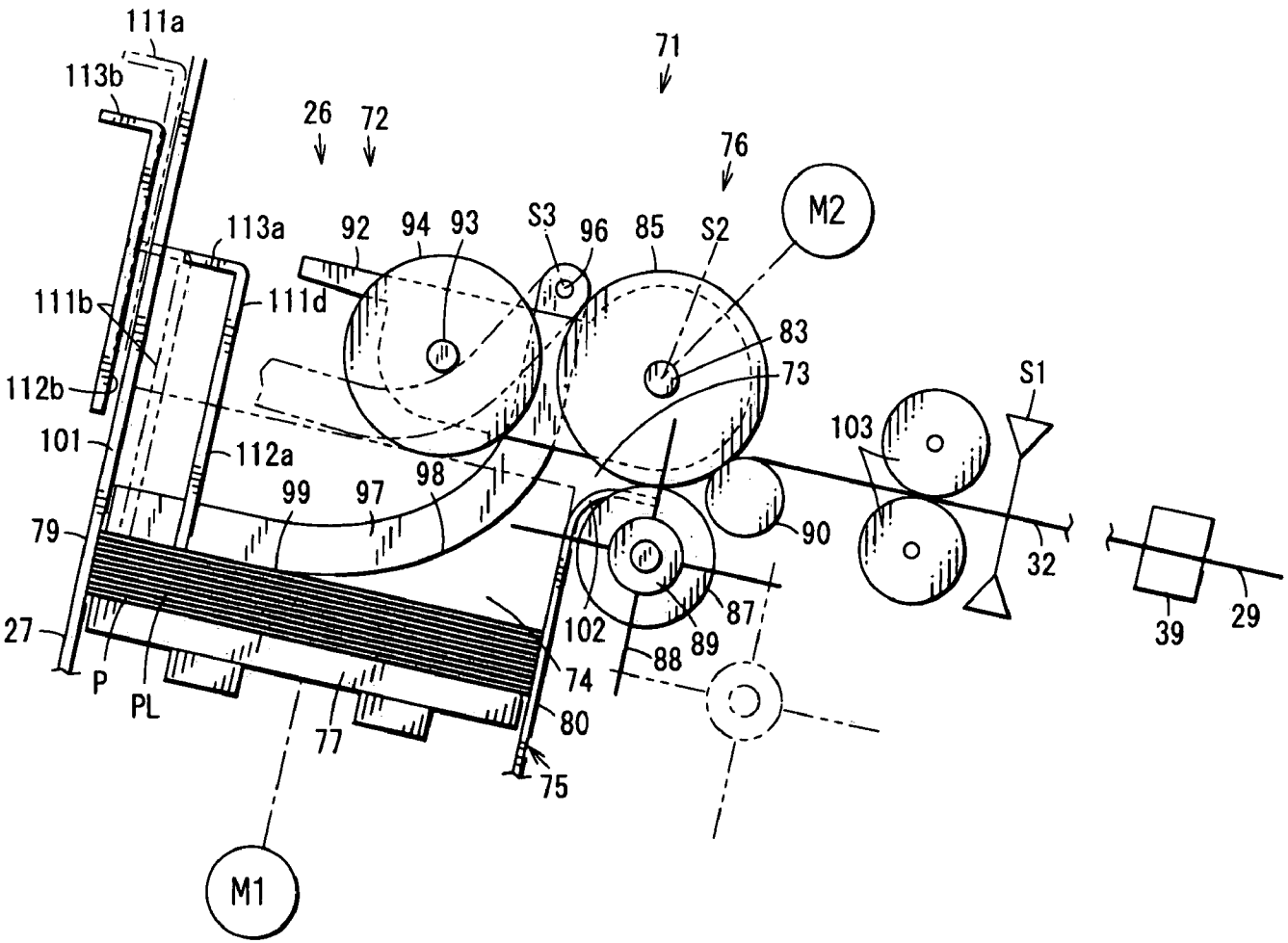
FIG. 1 is a side elevational view of an accumulating device, which shows one embodiment of the present invention.
Figure 8:
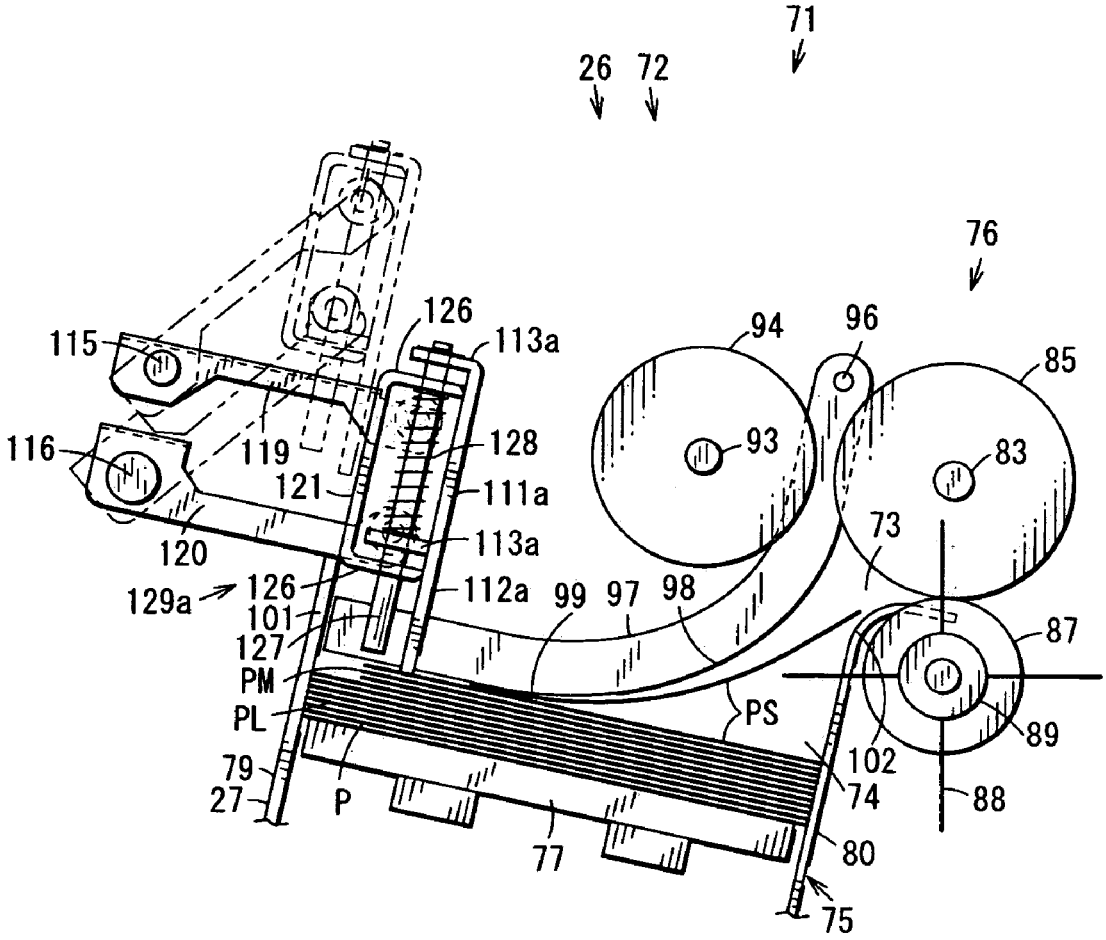
FIG. 8 is a view describing a second mode in which short-width bank notes are stopped by the short-width stopper of the same accumulating device.

As shown in FIG. 8 and FIG. 1, where more intermediate-width bank notes PM or more long-width bank notes PL are accumulated in the upper part area of the bank notes P accumulated on the accumulating stacker 77 in the accumulating space portion 74, the lower end of the short-width stopper 111*a* is brought into the upper surface of the intermediate-width bank notes PM or long-width bank notes PL in the way that the short-width stopper 111*a* moves to the advanced position. For example, as shown in FIG. 8, the short-width stopper 111*a* placed on the upper surface of the accumulated intermediate-width bank notes PM is elevated with respect to the supporting member 121 against the pressing of the spring 128. Therefore, while the upper surface of the accumulated intermediate-width bank notes PM or accumulated long-width bank notes PL are being pressed to the short-width stopper 111*a*, the stopper 111*a* stands by for stopping the short-width bank notes P planned to be taken in.

Figure 9:
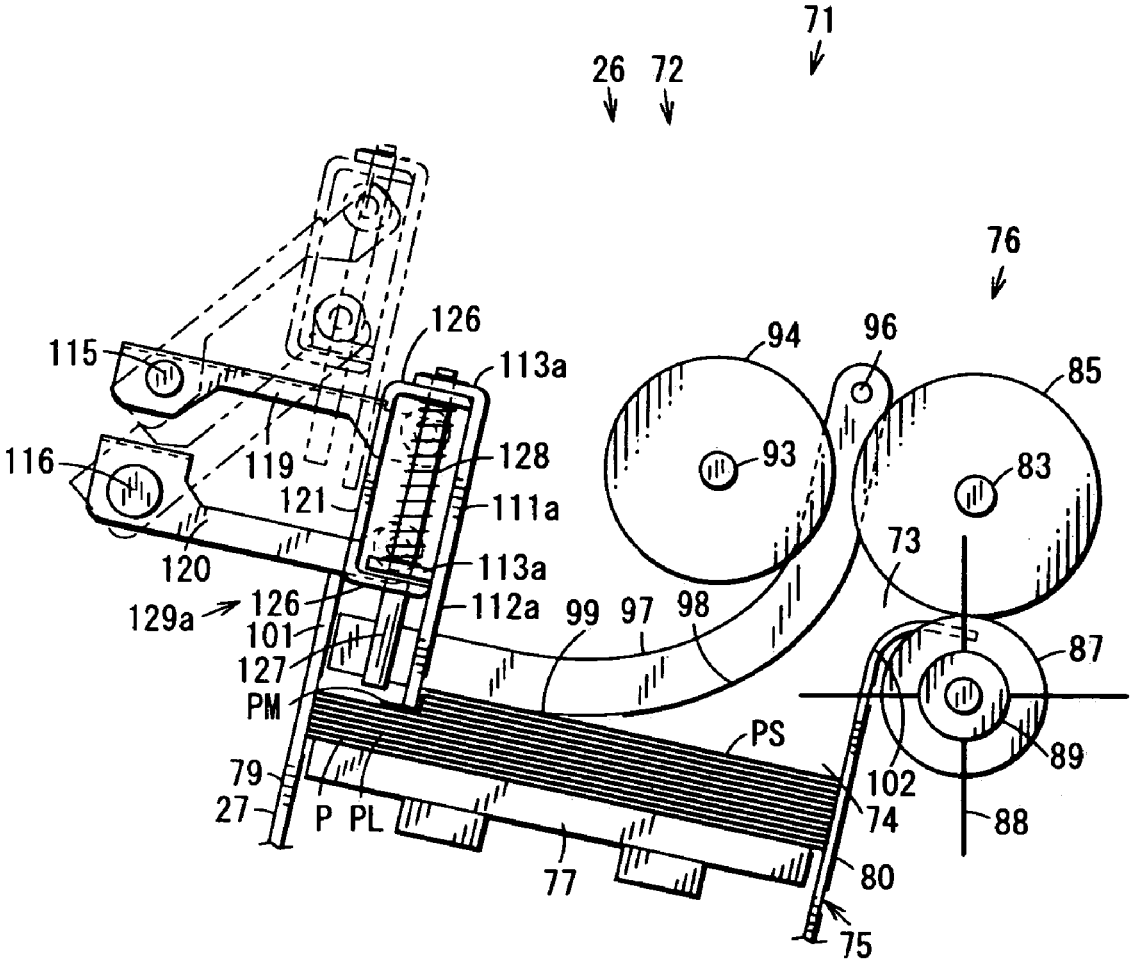
FIG. 9 is a view describing a third mode in which short-width bank notes are stopped by the short-width stopper of the same accumulating device.

As shown in FIG. 9, where more short-width bank notes PS are accumulated in the upper part area of the bank notes P accumulated on the accumulating stacker 77 in the accumulating space portion 74, and at the same time one or plurality of intermediate-width bank notes PM (or long-width bank notes PL) are mixed therein, the lower part of the short-width stopper 111*a* is caused to advance into the tip end side in the taking-in direction of the accumulated short-width bank notes PS, wherein the rear ends in the taking-in direction of the intermediate-width bank notes PM (or the long-width bank notes PL) mixed in the short-width bank notes PS are pressed downward by the short-width stopper 111*a*, and the stopper 111*a* stands by for stopping of short-width bank notes PS planned to be taken in. At this time, since the pressing force of the spring 128 that presses the short-width stopper 111*a* downward is weak, forced curving of the rear ends in the taking-in direction of the intermediate-width bank notes (or long-width bank notes PL) is restored by elevation of the short-width stopper 111*a*. Also, the rear ends in the taking-in direction of the intermediate-width bank notes PM (or the long-width bank notes PL) are pressed and curved downward. However, the rear ends in the taking-in direction of the intermediate-width bank notes PM (or long-width bank notes PL) are caused to move along the rear end regulating wall 80 by actions of the blade 88 of the blade roller 89 disposed at the side of the gate roller 87 when the intermediate-width bank notes PM (or long-width bank notes PM) are taken in, and the accumulating frame portion 75 is inclined downward to the rear end regulating wall 80 side and has an action by which the rear ends in the taking-in direction of the intermediate-width bank notes PM (or long-width bank notes PL) are caused to move along the rear end regulating wall 80. Therefore, the rear ends in the taking-in direction of the intermediate-width bank notes PM (or long-width bank notes PL) are not greatly separated from the rear end regulating wall 80.

The status of the short-width stopper 111*a* changes at the advanced position in response to a state where the accumulated bank notes P are short-width bank notes PS, intermediate-width bank notes PM or long-width bank notes PL. In addition, the guiding member 97 is placed on the upper surface of the accumulated bank notes P, and presses the accumulated bank notes P onto the accumulating stacker 77.

Further, where bank notes P identified by the bank note identification portion 39 and detected by the sensor S1 are a denomination of intermediate-width bank notes PM, the intermediate-width stopper 111*b* is caused to advance from the retreated position to the advanced position by drive of the motor M4.

Figure 10:
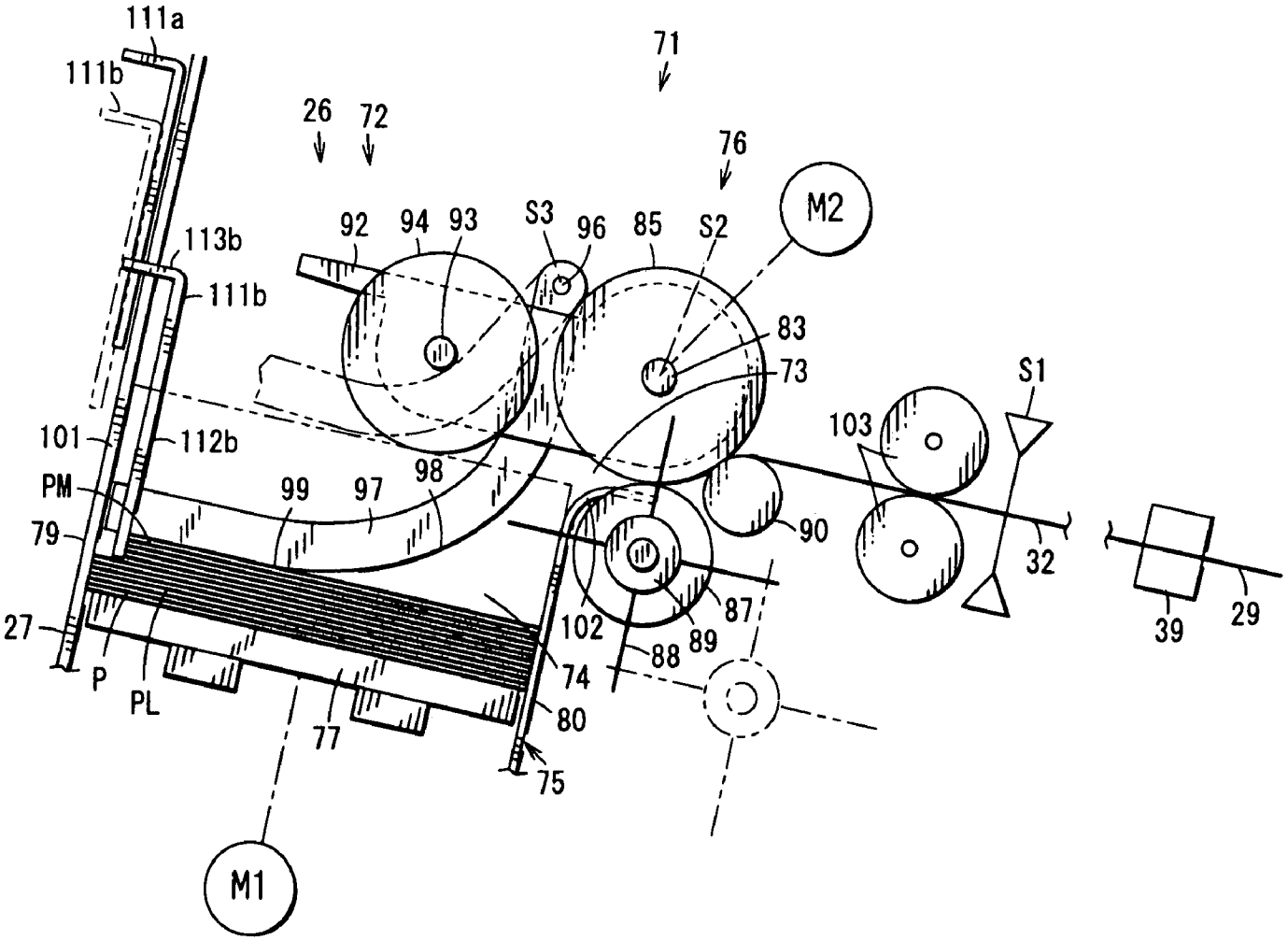
FIG. 10 is a view describing actions by which intermediate-width bank notes are stopped by an intermediate-width stopper of the same accumulating device.

At this time, as shown in FIG. 10, where more intermediate-width bank notes PM (or short-width bank notes PS) are accumulated in the upper part area of the bank notes P accumulated on the accumulating stacker 77 in the accumulating space portion 74, the lower part of the intermediate-width stopper 111*b* is caused to advance in the tip end side in the taking-in direction of the accumulated intermediate-width bank notes PM (or the short-width bank notes PS), and stands by for stopping intermediate-width bank notes PM planned to be taken in while stopping the tip ends in the taking-in direction of the accumulated intermediate-width bank notes PM (or short-width bank notes PS).

As shown in FIG. 1, where more long-width bank notes PL are accumulated in the upper part area of the bank notes P already accumulated on the accumulating stacker 77 in the accumulating space portion 74, the lower end of the intermediate width stopper 111*b* is brought into contact with the upper surface of the long-width bank notes PL in the way that the intermediate-width stopper 111*b* moves to the advanced position. The intermediate-width stopper 111*b* placed on the upper surface of the accumulated long-width bank notes PL is elevated against the pressing of the spring 139 with respect to the supporting member 132. Therefore, the stopper 111*b* stands by for stopping the intermediate-width bank notes PM planned to be taken in while the intermediate-width stopper 111*b* is pressing the upper surface of the already accumulated long-width bank notes PL. Also, the pressing force of the spring 139 is weak as in the spring 128.

The status of the intermediate-width stopper 111*b* at its advanced position differs in response to a state where the accumulated bank notes P are the short-width bank notes PS, intermediate-width bank notes PM or long-width bank notes PL. In addition, the guiding member 97 is placed on the upper surface of the accumulated bank notes P, and presses the accumulated bank notes P onto the accumulating stacker 77.

Figure 11:
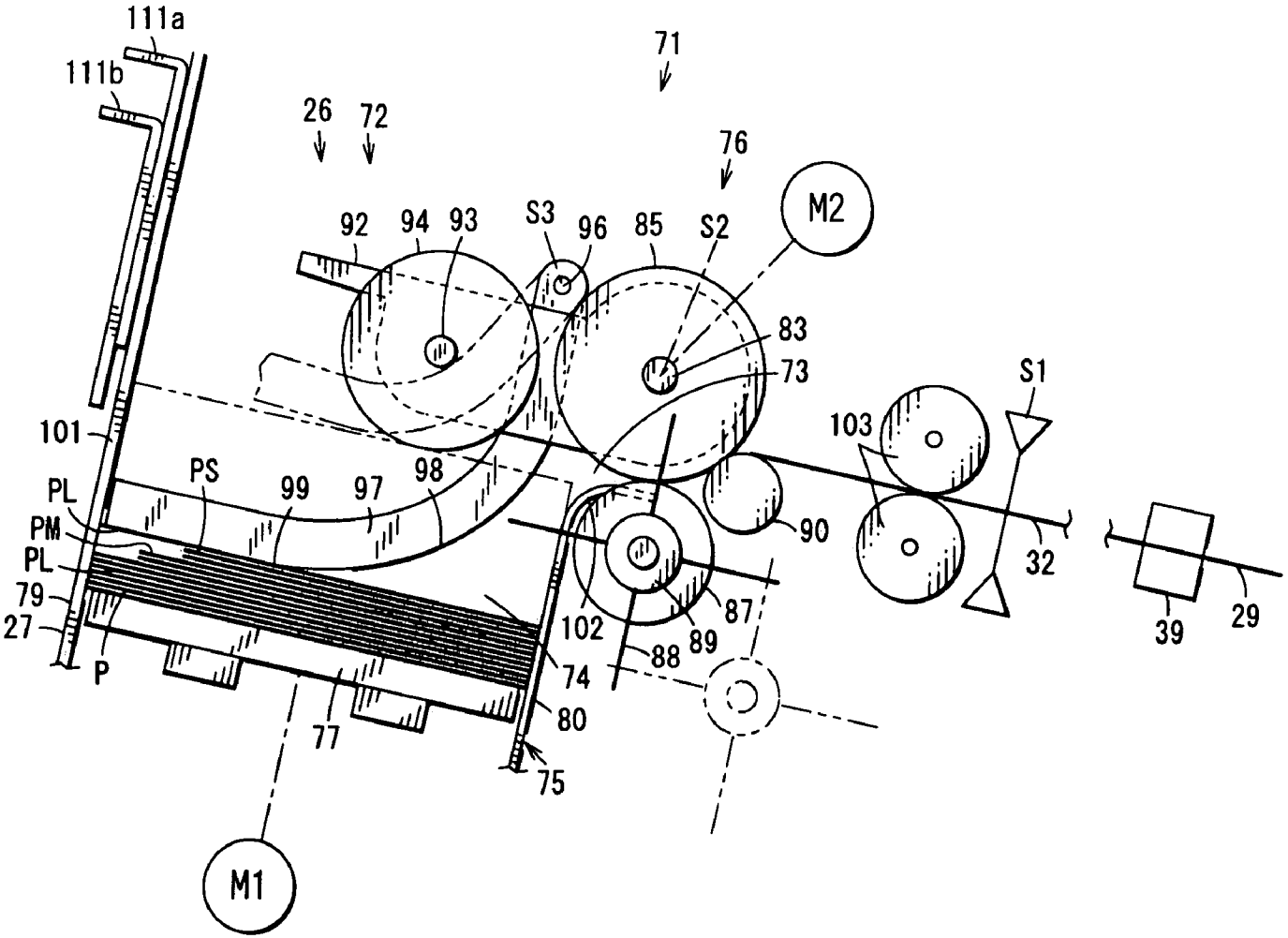
FIG. 11 is a view describing actions by which long-width bank notes are stopped by the same accumulating device.

In addition, the bank notes P identified by the bank note identification portion 39 and detected by the sensor S1 are a denomination of long-width bank notes PL, as shown in FIG. 11, neither the motor M3 nor M4 are driven, wherein both of the short-width stopper 111*a* and the intermediate-width stopper 111*b* are maintained at the retreated position, and the tip end regulating wall 79 stands by for stopping of long-width bank notes PL planned to be taken in.

And, as shown in FIG. 7 and FIG. 9, where short-width bank notes PS identified by the bank note identification portion 39 and detected by the sensor S1 are sent in from the storage conveying passage 32, the short-width bank notes PS are placed between the feed roller 85 and gate roller 87 and are taken from the taking-in and taking-out port 73 into the accumulating space portion 74, the tip ends in the taking-in direction of the short-width bank notes PS are guided onto the upper surface of the accumulated bank notes P by the guiding member 97, and the tip ends in the taking-in direction of the short-width bank notes PS are moved on the upper surface of the accumulated bank notes P, brought into contact with the short-width stopper 111*a* and stopped thereat. Then, the short-width bank notes PS are positioned at and accumulated in the accumulating position, that is, the temporary storage position, based on the position where the rear ends in the taking-in direction of the short-width bank notes PS are caused to move along the rear end regulating wall 80. With rotations of the blade 88 of the blade roller 89 disposed at the side of the gate roller 87, the short-width bank notes P are taken in the accumulating space portion 74 with the tip ends in the taking-in direction thereof oriented to the tip end regulating wall 79, and the rear ends in the taking-in direction of the taken-in short-width bank notes PS are operated so as to move along the rear end regulating wall 80.

At this time, since, as shown in FIG. 7 and FIG. 9, the short-width stopper 111*a* stops the tip ends in the taking-in direction of the short-width bank notes PS to be taken in while stopping the tip ends in the taking-in direction of the accumulated short-width bank notes PS or, as shown in FIG. 8 and FIG. 1, the same stopper 111*a* stops the tip ends in the taking-in direction of short-width bank notes PS to be taken in while pressing the upper surface of the accumulated intermediate-width bank notes PM or accumulated long-width bank notes PL, the short-width bank notes PS can be securely stopped without the tip ends in the taking-in direction of the short-width bank notes PS entering the underside of the short-width stopper 111*a*.

Further, since the guiding member 97 guides the tip ends in the taking-in direction of the short-width bank notes PS onto the upper surface of the accumulated bank notes P and guides the bank notes P to be taken in, for feeding along the upper surface of the accumulated bank notes P, the resiliency of the short-width bank notes PS are reinforced, and resiliency of the short-width bank notes PS to be taken in are prevented from being folded over, wherein the tip ends in the taking-in direction of the short-width bank notes PS whose resiliency is reinforced are securely stopped by the short-width stopper 111*a*, and the short-width bank notes PS can be securely accumulated.

Immediately after the short-width stopper 111*a* stops the short-width bank notes PS, the stopper 111*a* retreats to its retreated position outside the accumulating space portion 74, and stands by for taking of the next bank notes P into the accumulating space portion 74.

The guiding member 97 is raised equivalently to the thickness of the taken-in bank notes in line with the taking-in thereof, and the sensor S3 monitors the swinging angle of the guiding member 97, wherein whenever the swinging angle detected by the sensor S3 reaches a prescribed value as the upper surface height of the bank notes P accumulated on the accumulating stacker 77 is raised, the accumulating stacker 77 is gradually lowered and maintains the upper surface height, on which bank notes P are received and accumulated, within a fixed range.

Also, as shown in FIG. 10, where the intermediate-width bank notes PM identified by the bank note identification portion 39 and detected by the sensor S1 are sent in from the storage conveying passage 32, the guiding member 97 carries out operations similar to those for the above-described short-width bank notes PS, wherein the guiding member 97 guides the tip ends in the taking-in direction of the intermediate-width bank notes PM onto the upper surface of the accumulated bank notes P and guides the bank notes PM to be taken in, for feeding along the upper surface of the accumulated bank notes P. The tip ends in the taking-in direction of the intermediate-width bank notes PM are stopped by the intermediate-width stopper 111*b* that has advanced to the advanced position, and the rear ends in the taking-in direction of the intermediate-width bank notes PM are accumulated on the basis of the position along the rear end regulating wall 80. In addition, the intermediate-width stopper 111*b* is returned to the retreated position outside the accumulating space portion 74 immediately after the stopper 111*b* stops the intermediate-width bank notes PM, and stands by for taking-in of the next bank notes P into the accumulating space portion 74.

Further, as shown in FIG. 11, where long-width bank notes PL identified by the bank note identification portion 39 and detected by the sensor S1 are sent in from the storage conveying passage 32, while the long-width bank notes PL are being guided by the guiding member 97 as in the case of the above-described short-width bank notes PS and intermediate-width bank notes PM, the long-width bank notes PL are taken in the accumulating space portion 74, and the tip ends in the taking-in direction of the long-width bank notes PL are brought into contact with the tip end regulating wall 79 and thereby stopped. Then, the rear ends in the taking-in direction of the long-width bank notes PL are accumulated on the basis of the position where the rear ends thereof are caused to move along the rear end regulating wall 80.

Thus, when bank notes are taken in, the stopper 111*a* and 111*b* are selectively caused to advance in response to the denomination identification made by the bank note identification portion 39, and the tip ends in the taking-in direction of the bank notes P to be taken in are regulated by the stopper 111*a* and 111*b* or the tip end regulating wall 79, wherein the rear ends in the taking-in direction of the bank notes P can be securely accumulated at the accumulating position along the rear end regulating wall 80.

Next, where the bank notes P accumulated in the accumulating space portion 74 of the accumulating device 71 are taken in, the blade roller 89 is moved to the retreated position where it retreats from the side position between the gate rollers 87, that is, the taking-in position.

The accumulator stacker 77 is elevated, and the upper surface of the bank notes P on the accumulator stacker 77 is elevated to a prescribed taking-out height. That is, the accumulating stacker 77 is elevated, the upper surface of the bank notes P is brought into contact with the taking-out roller 94, and at the same time, the taking-out roller 94 is pushed upwards by causing the lever 92 to swing, wherein the accumulating stacker 77 is caused to stop elevating when the sensor S2 detects that the swinging angle of the lever 92 has become a prescribed angle. By elevating the upper surface of the bank notes P on the accumulating stacker 77 to a prescribed taking-out height, the upper surface of the bank notes P is brought into contact with the feed roller 85.

With rotations of the feed roller 85 and taking-out roller 94, friction surfaces provided at a part of the circumferential surface of the feed roller 85 and taking-out roller 94 are brought into contact with the bank notes P on the accumulating stacker 77 roughly at the same time, a single bank note P on the extreme surface of the accumulated bank notes, with which the friction surfaces are brought into contact is taken out to the taking-in and taking-out port 73, is placed between the feed roller 85 and the gate roller 87, and is sent out onto the storage conveying passage 32.

The sensor S2 monitors the swinging angle of the lever 92. If the height of the bank notes P on the accumulating stacker 77 is lowered in line with the taking-out action of the bank notes, the accumulating stacker 77 is elevated, wherein the taking-out height of the upper surface of the bank notes P on the accumulating stacker 77 is kept constant.

Therefore, since, according to the accumulating device 71, the stoppers 111*a* and 111*b* that advance to the advanced position between the tip end regulating wall 79 and the rear end regulating wall 80 from upward and stop the tip ends in the taking-in direction of short-width bank notes PS and intermediate-width bank notes PM whose length in the taking-in direction of bank notes P to be taken in are shorter than the long-width bank notes PL whose length is the longest are supported movably in the vertical direction, and are pressed downward, the stoppers 111*a* and 111*b* that have advanced to the advanced positions are changed over to a state where the stoppers 111*a* and 111*b* are brought into contact with the upper surface of the accumulated bank notes P in response to the length in the taking-in direction of the accumulated bank notes P and stop the tip ends in the taking-in direction of the short-width bank notes PS and intermediate-width bank notes PM taken in while pressing the upper surfaces thereof, and a state where the stoppers 111*a* and 111*b* advance to the tip end side in the taking-in direction of the accumulated bank notes P and stop the tip ends in the taking-in direction of short-width bank notes PS and intermediate-width bank notes PM to be taken in while stopping the tip ends in the taking-in direction thereof. Therefore, it is possible to securely stop the tip ends in the taking-in direction of bank notes P having dimensional differences by the stoppers 111*a* and 111*b* and possible to securely accumulate the bank notes P having dimensional differences on the basis of the rear ends in the taking-in direction thereof. In addition, since bank notes P having dimensional differences can be securely accumulated on the basis of the rear ends in the taking-in direction thereof, it is possible to securely take out the accumulated bank notes sheet by sheet.

By the guiding member 97, the tip ends in the taking-in direction of bank notes P can be guided onto the upper surface of the accumulated bank notes P, and the bank notes P to be taken in can be prevented from being folded over or bent since the resiliency of bank notes P moving on the upper surface of the accumulated bank notes Pare reinforced. Further, bank notes P can be securely stopped with the tip ends in the taking-in direction of bank notes P securely stopped by any one of the stoppers 111*a* and 112*a* and the tip end regulating wall 79.

The retreated positions of the stoppers 111*a* and 111*b* are the same position when taking in and taking out bank notes P and are in the vicinity of the tip end regulating wall 79 outside the accumulating space portion 74. Therefore, the stoppers 111*a* and 111*b* can be made simple in structure and inexpensive.

Also, in some countries, there are cases where respective bank notes P have differences in the length of the short-side direction in regard to all the denominations of the bank notes to be processed, and there are cases where there are slight dimensional differences among the short-width bank notes PS, intermediate-width bank notes PM, and long-width bank notes PL. However, the accumulating device has an action by which the rear ends in the taking-in direction of bank notes P are caused to move along the rear end regulating wall 80 by the actions of the blade 88 of the blade roller 89, and has an action by which the rear ends in the taking-in direction of bank notes P are caused to move along the rear end regulating wall 80 since the accumulating frame portion 75 is lowered and inclined to the rear end regulating wall 80 side, the rear ends in the taking-in direction of the bank notes P can be positioned along the rear end regulating wall 80 and can be accumulated there along. And, although, when taking out the bank notes P, friction surfaces provided at a part of the circumferences of the feed roller 85 and taking-out roller 94 are brought into contact with the bank notes P roughly at the same time and the taking-out is commenced, more or less dimensional differences in the length of the above-described bank notes P are equivalent to the range of errors in commencement of the taking-out, wherein the bank notes P can be normally taken out.

In addition, if the retreated positions of the stoppers 111*a* and 111*b* are made into two different positions when taking in and taking out bank notes, the retreated position in the taking out is further set back than the retreated position in the taking-in and is determined outside the accumulating space portion 74, movement for advancement and retreat of the stoppers 111*a* and 111*b* can be quickened when taking in bank notes, and at the same time, the stoppers 111*a* and 111*b* do not constitute any hindrance in the taking-out movement when taking out bank notes.

Further, since the circulating type bank note depositing and dispensing machine 11 is provided with an accumulating device 71, collective and temporary storage can be securely carried out by taking-in of bank notes having dimensional differences, and the temporarily stored bank notes having dimensional differences can also be securely taken out. Also, when the depositing is approved, temporarily stored bank notes P accumulated in the accumulating device 71 can be taken out sheet by sheet by the taking-in and taking-out means 76 and can be received, and when the depositing is not approved, the door 27 of the tip end regulating wall 27 of the accumulating device 71 is opened, wherein the temporarily stored bank notes P can be collectively returned in a quickly.

In addition, the above-described accumulating device 71 is available for both taking-in and taking-out of bank notes P. However, it is composed to be an accumulating device exclusive to the taking-in of bank notes, wherein bank notes P having dimensional differences can be securely accumulated.

Further, the accumulating device 71 is applicable, in addition to the circulating type bank note depositing and dispensing machine 11, to an accumulating apparatus, which is capable of accumulating sheets or the like having dimensional differences such as bank notes, bills, cards, etc., for example, a bank note depositing machine, a bank note depositing and dispensing machine, bank note exchanging machine, bill processing machine, and card processing machine, etc. In such cases, actions and effects similar to those in the above description can be brought about.

According to a first aspect of the invention, at least a stopper that advances from upward to the advanced position between the tip end regulating wall and the rear end regulating wall and stops the tip ends in the taking-in direction of sheets or the like to be taken in, whose length in the taking-in direction thereof is shorter than the maximum length is supported movably in the vertical direction, and is pressed in the downward direction. Therefore, since the stopper is changed over to a state where the stopper advancing to its advanced position is brought into contact with the upper surface of accumulated sheets or the like in response to the length in the taking-in direction of the accumulated sheets or the like and the tip ends in the taking-in direction of the sheets or the like taken in while the upper surface thereof are being pressed are stopped, and a state where the stopper advances to the tip end side in the taking-in direction of the accumulated sheets or the like and the tip ends in the taking-in direction of sheets or the like taken in while the tip ends in the taking-in direction thereof are being stopped, the tip ends in the taking-in direction of sheets or the like having dimensional differences can be securely stopped by the stopper, and the sheets or the like having dimensional differences can be securely accumulated on the basis of the rear ends in the taking-in direction thereof.

According to a second aspect of the invention, it is possible to securely accumulate bank notes even if the bank notes are filmsy, in addition to the effects of the first aspect.

According to a third aspect of the invention, the tip ends in the taking-in direction of sheets or the like are guided onto the upper surface of the accumulated sheets or the like, and the resilience of sheets or the like moving on the upper surface of the already accumulated sheets or the like is reinforced, wherein sheets or the like to be taken in are prevented from being folded over, and it is possible to securely stop and accumulate the tip ends in the taking-in direction of sheets or the like by any one of the stoppers or the tip end regulating wall.

According to a fourth aspect of the invention, at least a stopper that advances from upward to the advanced position between the tip end regulating wall and the rear end regulating wall and stops the tip ends in the taking-in direction of bank notes to be taken in, whose length in the taking-in direction thereof is shorter than the maximum length is supported movably in the vertical direction, and is pressed in the downward direction. Therefore, since the stopper is changed over to a state where the stopper advancing to its advanced position is brought into contact with the upper surface of accumulated bank notes in response to the length in the taking-in direction of the accumulated bank notes and the tip ends in the taking-in direction of the bank notes taken in while the upper surface thereof are being pressed are stopped, and a state where the stopper advances to the tip end side in the taking-in direction of the accumulated bank notes and the tip ends in the taking-in direction of bank notes taken in while the tip ends in the taking-in direction thereof are being stopped, the tip ends in the taking-in direction of bank notes having dimensional differences can be securely stopped by the stopper, and the bank notes having dimensional differences can be securely accumulated on the basis of the rear ends in the taking-in direction thereof. Further, since it is possible to securely accumulate different bank notes having dimensional differences on the basis of the rear ends in the taking-in direction thereof, it is possible to securely take out the accumulated bank notes sheet by sheet.

According to a fifth aspect of the invention, in addition to the effects of the accumulating device as set forth in the fourth aspect, since the retreat position of the stopper is made into the same position when bank notes are taken in and taken out, and is determined in the vicinity of the tip end regulating wall outside the accumulating space portion, the structure thereof can be simplified and can be made inexpensive.

According to a sixth aspect of the invention, in addition to the effects of the accumulating device as set forth in the fourth aspect, since the retreat position of the stoppers can be made into two different positions when bank notes are taken in and taken out, and at the same time, the retreat position in taking-out bank notes is further retreated from the retreat position in taking-in thereof and is determined outside the accumulating space portion, the stopper can be quickly moved for advancement and retreating when taking in bank notes, and simultaneously the stoppers do not constitute any hindrance in a taking-out movement when taking out bank notes.

According to a seventh aspect of the invention, in addition to the effects of the accumulating device as set forth in any one of the fourth aspect through the sixth aspect, it is possible to collectively and quickly take out bank notes accumulated on the accumulating stacker by opening the door of the tip end regulating wall.

With a circulating type bank note depositing and dispensing machine according to an eighth aspect of the invention, since the temporary storage portion thereof which collectively and temporarily stores deposited bank notes is provided with an accumulating device as set forth in any one of the fourth aspect through the six aspect, bank notes having dimensional differences can be collectively and temporarily stored by taking-in, and the temporarily stored bank notes can be securely taken out.

With a circulating type bank note depositing and dispensing machine according to a ninth aspect of the invention, in addition to the effects of the circulating type bank note depositing and dispensing machine according to the eighth aspect, when the depositing is approved, temporarily stored bank notes accumulated by the accumulating device can be taken out from said accumulating space portion and received said conveying passage sheet by sheet by the taking-in and taking-out means, and when the depositing is not approved, temporarily stored bank notes can be collectively returned quickly by opening the door of the tip end regulating wall of the accumulating device.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claim is:

1. An accumulating device for accumulating sheets, which have differences in size, in a mixed state, comprising:

an information detecting portion, which is provided in a conveying passage for conveying sheets, for detecting information pertaining to the length in the taking-in direction of sheets;

a sheet accumulating portion including an accumulating space portion for accumulating said sheets, an intake for taking in the sheets, which are taken from said conveying passage, in the accumulating space portion sheet by sheet, an accumulating stacker for accumulating sheets taken in said accumulating space portion in the vertical direction, an accumulating stacker drive portion for driving to lower said accumulating stacker when taking in said sheets, a tip end regulating wall for regulating the tip end in the taking-in direction of the sheets having a maximum length in the taking-in direction of sheets which are taken in, a rear end regulating wall for regulating the rear end in the taking-in direction of the sheets to be taken in, at least one stopper that can move between an advancement position and a retreating position, said advancement position being a position that is between the tip end regulating wall and the rear end regulating wall, and on either the accumulating stacker or the sheets accumulated on the accumulating stacker, and simultaneously is the position at which the tip end in the taking-in direction of sheets that are taken into the accumulating space portion is stopped, the length in the taking-in direction of said sheets being shorter than said maximum length, and said retreating position being a position that is above the accumulating stacker and the sheets accumulated on the accumulating stacker and at which the tip end in the taking-in direction of the sheets that are taken into the accumulating space portion is not stopped, a stopper support for supporting the stopper so as to be movable in the vertical direction and simultaneously pressing the same in the downward direction, and changing the stopper to a state where the stopper advancing to its advanced position is brought into contact with the upper surface of accumulated sheets in response to the length in the taking-in direction of the accumulated sheets and the tip ends in the taking-in direction of the sheets taken in while the upper surface thereof are being pressed are stopped, and a state where the stopper advances to the tip end side in the taking-in direction of the accumulated sheets and the tip ends in the taking-in direction of sheets taken in while the tip ends in the taking-in direction thereof are being stopped, and a stopper driving portion for driving the stopper to advance and retreat between the advanced position and retreated position of the stopper; and a controlling portion for controlling said accumulating stacker driving portion so that, when taking in said sheets, the upper surface position of said accumulated sheets is located at a constant height, and simultaneously controlling said stopper driving portion on the basis of detection of sheets by said information detecting portion for detecting information pertaining to the length in the taking-in direction of sheets.

2. The accumulating device as set forth in claim 1, wherein the sheets are bank notes.

3. The accumulating device as set forth in claim 1 or 2, further comprising at least one guiding member for swingably guiding the tip ends in the taking-in direction of sheets taken in by the intake onto the upper surface of the accumulated sheets, wherein the tip ends in the taking-in direction of the sheets guided by said at least one guiding member and moved on the upper surface of the accumulated sheets is stopped by any one of the stopper and tip end regulating walls.

4. An accumulating device for accumulating bank notes, which have differences in size, in a mixed state, comprising:

a bank note identification portion, which is provided in a conveying passage for conveying bank notes, for identifying the denominations of the bank notes;

a bank note accumulating portion including an accumulation space in which said bank notes are accumulated, an intake/outtake unit for taking in bank notes, which are taken from said conveying passage, in said accumulation space portion, sheet by sheet and taking out the bank notes sheet by sheet as necessary, an accumulating stacker for accumulating bank notes taken in said accumulation space portion in the vertical direction, an accumulating stacker driving portion for driving to elevate and lower said accumulating stacker, a tip end regulating wall for regulating the tip end in the taking-in direction of the bank notes having a maximum length in the taking-in direction of bank notes which are taken in, a rear end regulating wall for regulating the rear end in the taking-in direction of the bank notes to be taken in, at least one stopper that can move between an advancement position and a retreating position, said advancement position being a position that is between the tip end regulating wall and the rear end regulating wall, and on either the accumulating stacker or the bank notes accumulated on the accumulating stacker, and simultaneously is the position at which the tip end in the taking-in direction of bank notes that are taken into the accumulating space portion is stopped, the length in the taking-in direction of said bank notes being shorter than said maximum length, and said retreating position being a position that is above the accumulating stacker and the bank notes accumulated on the accumulating stacker and at which the tip end in the taking-in direction of the bank notes that are taken into the accumulating space portion is not stopped, a stopper support for supporting the stopper so as to be movable in the vertical direction and simultaneously pressing the same in the downward direction, and changing the stopper to a state where the stopper advancing to its advanced position is brought into contact with the upper surface of accumulated bank notes in response to the length in the taking-in direction of the accumulated bank notes and the tip ends in the taking-in direction of the bank notes taken in while the upper surface thereof are being pressed are stopped, and a state where the stopper advances to the tip end side in the taking-in direction of the accumulated bank notes and the tip ends in the taking-in direction of bank notes taken in while the tip ends in the taking-in direction thereof are being stopped, and a stopper driving portion for driving the stopper to advance and retreat between the advanced position and retreated position of the stopper;

a bank note arrival detecting portion, which is provided in said conveying passage, for detecting that bank notes identified by said bank note identification portion arrives in the vicinity of said bank note accumulating portion; and a controlling portion for controlling said accumulating stacker driving portion so that, when taking in said bank notes, the upper surface position of said accumulated bank notes is located at a constant height, and simultaneously controlling said stopper driving portion on the basis of identification of bank notes by said bank note identification portion and detection of bank notes by said bank note arrival detecting portion.

5. The accumulating device as set forth in claim 4, wherein the retreat position of the stopper is made into the same position when taking in and taking out bank notes, and simultaneously is a position above the accumulating stacker and the bank notes accumulated on the accumulating stacker, as well as outside the tip end regulating wall which forms the accumulating space.

6. The accumulating device as set forth in claim 4, wherein said stopper is designed such that when bank notes are taken in, the stopper moves, in response to the length in the taking-in direction of the bank notes that are being taken into the accumulating space, between the advancement position and a retreat position that is located outside the tip end regulating wall, which forms the accumulating space, and that when bank notes are taken out, the stopper is at a retreat position that is located further outward of the tip end regulating wall, which forms the accumulating space, than is said retreat position when bank notes are taken in.

7. The accumulating device as set forth in any one of claims 4 through 6, wherein said tip end regulating wall is provided with an openable door through which the bank notes on the accumulating stacker can be collectively taken out.

8. A circulating type bank note depositing and dispensing machine capable of depositing and dispensing bank notes and circulatively using the deposited bank notes as dispensing bank notes, comprising the accumulating device, which is described in any one of claims 4 through 6, in a temporary storage portion for temporarily and collectively storing the deposited bank notes.

9. The circulating type bank note depositing and dispensing machine as set forth in claim 8, where in said tip and regulating wall of the accumulating device further comprising: an openable door, wherein temporarily stored bank notes are taken out from said accumulating space portion and received at said conveying passage by the intake/outtake unit when the depositing is approved, and the temporarily stored bank notes can be collectively taken out by opening said door when the depositing is not approved.

* * * * *

UNITED STATES PATENT AND TRADEMARK OFFICE

CERTIFICATE OF CORRECTION

PATENT NO. : 7,029,008 B2
APPLICATION NO. : 10/694399
DATED : April 18, 2006
INVENTOR(S) : Mitsuo Nishida et al.

It is certified that error appears in the above-identified patent and that said Letters Patent is hereby corrected as shown below:

In the Claim 9, Column 28, Line 30, delete the phrase "where in said tip end regulating wall of the accumulating device further comprising: an openable door."

In Claim 9, Column 28, Line 35, after the word "and" insert the phrase -- wherein said tip end regulating wall of the accumulating device further comprises an openable door such that--.

Signed and Sealed this

Sixth Day of February, 2007

JON W. DUDAS
*Director of the United States Patent and Trademark Office*